US006499581B2

(12) United States Patent
Yoshida et al.

(10) Patent No.: US 6,499,581 B2
(45) Date of Patent: Dec. 31, 2002

(54) COIN DISCRIMINATING APPARATUS

(75) Inventors: Toshio Yoshida; Takao Moritani; Shigetoshi Imai, all of Osaka (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/739,057

(22) Filed: Dec. 18, 2000

(65) Prior Publication Data

US 2001/0008200 A1 Jul. 19, 2001

(30) Foreign Application Priority Data

Dec. 21, 1999 (JP) ..... 11-362184

(51) Int. Cl.[7] ..... G07D 5/08

(52) U.S. Cl. ..... 194/318; 194/317; 194/328; 194/330; 382/136

(58) Field of Search ..... 194/328, 330, 194/318, 317; 382/136

(56) References Cited

U.S. PATENT DOCUMENTS

| | | | | | |
|---|---|---|---|---|---|
| 3,921,003 | A | * | 11/1975 | Greene | 194/207 |
| 4,088,144 | A | * | 5/1978 | Zimmermann | 453/11 |
| 4,108,296 | A | * | 8/1978 | Hayashi et al. | 194/318 |
| 4,124,111 | A | * | 11/1978 | Hayashi | 194/319 |
| 4,249,648 | A | * | 2/1981 | Meyer | 194/212 |
| 4,429,407 | A | * | 1/1984 | Furuya | 377/39 |
| 4,531,625 | A | * | 7/1985 | Yonekura et al. | 194/334 |
| 4,842,119 | A | * | 6/1989 | Abe | 194/317 |
| 4,899,392 | A | * | 2/1990 | Merton | 194/302 |

(List continued on next page.)

FOREIGN PATENT DOCUMENTS

JP 8-36661 2/1996

*Primary Examiner*—Donald P. Walsh
*Assistant Examiner*—Jeffrey A. Shapiro
(74) *Attorney, Agent, or Firm*—Cohen, Pontani, Lieberman & Pavane

(57) ABSTRACT

A coin discriminating apparatus includes a magnetic sensor for detecting magnetic properties of a coin being transported and producing magnetic data of the coin, an optical sensor for producing optical data of the coin, a reference optical data memory for storing reference optical data of an obverse surface and a reverse surface of coins of each denomination, a reference magnetic data memory for storing reference magnetic data of an obverse surface and a reverse surface of coins of each denomination to be discriminated, a first coin discriminator for comparing optical data of the coin produced by the optical sensor with reference optical data of an obverse surface and a reverse surface of coins of each denomination and determining whether or not the coin is acceptable and the denomination of the coin, and a second coin discriminator for reading from the reference magnetic data memory magnetic reference data selected depending upon whether reference optical data of the obverse surface of a coin of a certain denomination or those of the reverse surface of the coin of the denomination were used when the first coin discriminator determined the coin to be acceptable and the denomination of the coin based thereon and comparing them with the magnetic data produced by the magnetic sensor, thereby finally discriminating whether or not the coin is acceptable and the denomination of the coin. According to the thus constituted coin discriminating apparatus, it is possible to accurately discriminate a counterfeit coin even when optical data acquired from the counterfeit coin such as diameter data and surface pattern data thereof coincide with those of genuine coins of a certain denomination and when the magnetic data acquired from the counterfeit coin are similar to those of coins of the denomination.

24 Claims, 14 Drawing Sheets

U.S. PATENT DOCUMENTS 5,002,174 A * 3/1991 Yoshihara ..... 194/317
5,015,214 A * 5/1991 Suzuki ..... 453/56
5,133,019 A * 7/1992 Merton et al. ..... 194/302
5,230,653 A * 7/1993 Shinozaki et al. ..... 453/4
5,316,124 A * 5/1994 Barnes et al. ..... 194/206
5,366,407 A * 11/1994 Sentoku ..... 453/17
5,495,931 A * 3/1996 Meyer-Steffens et al. ... 194/214
5,503,262 A * 4/1996 Baudat et al. ..... 194/206
5,518,101 A * 5/1996 Simizu et al. ..... 194/317
5,538,123 A * 7/1996 Tsuji ..... 194/303
5,542,518 A * 8/1996 Kurosawa et al. ..... 194/206
5,579,886 A * 12/1996 Ishida et al. ..... 194/202
5,662,205 A * 9/1997 Levasseur ..... 194/317
5,673,781 A * 10/1997 Costello et al. ..... 194/317
5,697,483 A * 12/1997 Ishida et al. ..... 194/217
5,743,372 A * 4/1998 Furuya ..... 194/318
5,767,506 A * 6/1998 Bell ..... 194/318
5,788,046 A * 8/1998 Lamah ..... 194/317
5,839,563 A * 11/1998 Takahashi ..... 194/328
5,848,193 A * 12/1998 Garcia ..... 382/199
5,899,804 A * 5/1999 Chiba et al. ..... 194/346
5,970,165 A * 10/1999 Itako ..... 194/209
5,989,118 A * 11/1999 Chiba et al. ..... 453/11
6,026,946 A * 2/2000 McCarty, Jr. ..... 194/317
6,082,518 A * 7/2000 Itako et al. ..... 194/317
6,196,371 B1 * 3/2001 Martin et al. ..... 194/317
6,223,877 B1 * 5/2001 McGinty et al. ..... 194/317
6,260,757 B1 * 7/2001 Strisower ..... 194/205
6,328,150 B1 * 12/2001 Hibari ..... 194/317

* cited by examiner

COIN DISCRIMINATING APPARATUS

BACKGROUND OF THE INVENTION

The present invention relates to a coin discriminating apparatus and, in particular, to a coin discriminating apparatus for accurately discriminating a counterfeit coin even when optical data acquired from the counterfeit coin such as diameter data and surface pattern data thereof coincide with those of genuine coins of a certain denomination and when the magnetic data acquired from the counterfeit coin are similar to those of coins of the denomination.

DESCRIPTION OF THE PRIOR ART

Japanese Patent Application Laid Open No. 8-36661 discloses a coin discriminating apparatus in which magnetic data indicating magnetic properties of coins are produced by a magnetic sensor and coin optical data, i.e. diameter data and surface pattern data, are produced based on image data produced by an optical sensor, thereby discriminating whether a coin is acceptable and the denomination of a coin when the coin is discriminated to be acceptable in accordance with the magnetic data, the diameter data and the surface pattern data of the coin.

However, only a single kind of reference magnetic data are assigned to each denomination of coins in this coin discriminating apparatus. Therefore, in the case where optical data acquired from a counterfeit coin, such as diameter data and surface pattern data thereof, coincide with those acquired from coins of a certain denomination and when the magnetic data acquired from the counterfeit coin are similar with those of coins of the denomination, it is difficult to accurately discriminate the counterfeit coin.

SUMMARY OF THE INVENTION

It is therefore an object of the present invention to provide a coin discriminating apparatus capable of accurately discriminating a counterfeit coin even when optical data acquired from the counterfeit coin such as diameter data and surface pattern data thereof coincide with those of genuine coins of a certain denomination and when the magnetic data acquired from the counterfeit coin are similar to those of coins of the denomination.

The above and other objects of the present invention can be accomplished by a coin discriminating apparatus comprising magnetic sensor means for detecting magnetic properties of a coin being transported and producing magnetic data of the coin, optical sensor means for producing optical data of the coin, reference optical data storing means for storing reference optical data of an obverse surface and a reverse surface of coins of each denomination, reference magnetic data storing means for storing reference magnetic data of an obverse surface and a reverse surface of coins of each denomination to be discriminated, first coin discriminating means for comparing optical data of the coin produced by the optical sensor means with reference optical data of an obverse surface and a reverse surface of coins of each denomination and determining whether or not the coin is acceptable and the denomination of the coin, and second coin discriminating means for reading from the reference magnetic data storing means magnetic reference data selected depending upon whether reference optical data of the obverse surface of a coin of a certain denomination or those of the reverse surface of the coin of the denomination were used when the first coin discriminating means determined the coin to be acceptable and the denomination of the coin based thereon and comparing them with the magnetic data produced by the magnetic sensor means, thereby finally discriminating whether or not the coin is acceptable and the denomination of the coin.

The present invention is based on the findings that magnetic data of a coin detected by a reflection type magnetic sensor in which a transmitting coil and a receiving coil are on the same side of the coin differ, depending upon whether the obverse surface of the coin or the reverse surface thereof has been detected, according to the raised and depressed patterns of the obverse surface and the reverse surface of the coin, that magnetic data of a coin detected by a transmission type magnetic sensor in which a transmitting coil and a receiving coil are on the different sides of the coin differ depending upon the distance between the transmitting coil and the coin, and that the magnetic data of the coin are therefore different, depending upon whether the obverse surface or the reverse surface of the coin has been detected, according to the raised and depressed patterns of the obverse surface and the reverse surface of the coin.

According to the present invention, whether or not a coin is acceptable and the denomination of the coin are detected by the first coin discriminating means and the second coin discriminating means reads from the reference magnetic data storing means magnetic reference data selected depending upon whether reference optical data of the obverse surface of a coin of a certain denomination or those of the reverse surface of the coin of the denomination were used when the first coin discriminating means determined the coin to be acceptable and the denomination of the coin based thereon and compares them with the magnetic data produced by the magnetic sensor means, thereby finally discriminating whether or not the coin is acceptable and the denomination of the coin. Therefore, it is possible to accurately discriminate a counterfeit coin even when optical data of the counterfeit coin, such as diameter data and surface pattern data thereof, coincide with those of coins of a certain denomination and when the magnetic data acquired from the counterfeit coin are similar to those of coins of the denomination.

In a preferred aspect of the present invention, the magnetic sensor means comprises at least one transmitting coil and receiving coil pair and the members of the at least one transmitting coil and receiving coil pair are disposed on the same side of a coin being transported.

In another preferred aspect of the present invention, the magnetic sensor means comprises at least one transmitting coil and receiving coil pair and the members of the at least one transmitting coil and receiving coil pair are disposed on the different sides of a coin being transported.

In a further preferred aspect of the present invention, the optical sensor means comprises a light source for emitting light toward one surface of the coin and light receiving means for photoelectrically receiving light emitted from the light source and reflected by the one surface of the coin and producing image pattern data of the one surface of the coin.

In a further preferred aspect of the present invention, the image pattern data include data relating to diameter of the coin and pattern data and the reference optical data include reference data relating to diameters of coins of each denomination to be discriminated and reference pattern data of obverse surfaces and reverse surfaces of coins of each denomination and the coin discriminating apparatus further includes pattern data storing means for storing image pattern data.

In a further preferred aspect of the present invention, the first coin discriminating means is adapted for comparing the data relating to diameter of the coin stored in the pattern data storing means and the reference data relating to diameter of coins of each denomination stored in the reference optical data storing means, thereby determining the denomination of the coin, reading the reference pattern data of obverse surfaces and reverse surfaces of coins of each denomination from the reference optical data storing means and comparing them with image pattern data of the coin stored in the pattern data storing means, thereby discriminating whether or not the coin is acceptable and the denomination of the coin, and the second coin discriminating means is adapted for reading from the reference magnetic data storing means magnetic reference data selected depending upon whether reference pattern data of the obverse surface of a coin of a certain denomination or those of the reverse surface of the coin of the denomination were used when the first coin discriminating means determined the coin to be acceptable and the denomination of the coin based thereon and comparing them with the magnetic data produced by the magnetic sensor means, thereby finally discriminating whether or not the coin is acceptable and the denomination of the coin.

In a further preferred aspect of the present invention, the optical sensor means comprises a first light source for emitting light toward one surface of the coin, first light receiving means for photoelectrically receiving light emitted from the first light source and reflected by the one surface of the coin and producing image pattern data of the one surface of the coin, first pattern data storing means for storing the image pattern data of the one surface of the coin produced by the first light receiving means, a second light source for emitting light toward the other surface of the coin, second light receiving means for photoelectrically receiving light emitted from the second light source and reflected by the other surface of the coin and producing image pattern data of the other surface of the coin, and second pattern data storing means for storing the image pattern data of the other surface of the coin produced by the second light receiving means, the reference optical data storing means being adapted for storing reference pattern data of obverse surfaces and reverse surfaces of coins of each denomination, the first coin discriminating means includes first discriminating means for comparing the image pattern data of the one surface of the coin stored in the first pattern data storing means with the reference pattern data of obverse surfaces and reverse surfaces of coins of each denomination stored in the reference optical data storing means and determining whether or not the coin is acceptable and the denomination of the coin, second discriminating means for comparing the image pattern data of the other surface of the coin stored in the second pattern data storing means with the reference pattern data of obverse surfaces and reverse surfaces of coins of each denomination stored in the reference optical data storing means and determining whether or not the coin is acceptable and the denomination of the coin, and third discriminating means for determining whether or not the coin is acceptable and the denomination of the coin based on the results of discrimination made by the first discriminating means and the second discriminating means, the second coin discriminating means is adapted for reading from the reference magnetic data storing means reference magnetic data which correspond to the denomination of coin discriminated by the third discriminating means and which correspond to the coin surface used by whichever of the first discriminating means and the second discriminating means discriminated the denomination of the coin based on the image pattern data of a surface on the side of the transmitting coil of the magnetic sensor, and comparing them with the magnetic data of the coin produced by the magnetic sensor, thereby finally discriminating whether or not the coin is acceptable and the denomination of the coin.

According to this further preferred aspect of the present invention, the first coin discriminating means includes first discriminating means for comparing the image pattern data of the one surface of the coin stored in the first pattern data storing means with the reference pattern data of obverse surfaces and reverse surfaces of coins of each denomination stored in the reference optical data storing means and determining whether or not the coin is acceptable and the denomination of the coin, second discriminating means for comparing the image pattern data of the other surface of the coin stored in the second pattern data storing means with the reference pattern data of obverse surfaces and reverse surfaces of coins of each denomination stored in the reference optical data storing means and determining whether or not the coin is acceptable and the denomination of the coin, and third discriminating means for determining whether or not the coin is acceptable and the denomination of the coin based on the results of discrimination made by the first discriminating means and the second discriminating means, and since the first coin discriminating means determines whether or not the coin is acceptable and the denomination of the coin based on the image pattern data of both surfaces of the coin and the second coin discriminating means reads the reference magnetic data of a coin from the reference magnetic data memory based on the denomination of the coin determined by the third discriminating means, the second coin discriminating means can discriminate whether or not the coin is acceptable and the denomination of the coin based on the reference magnetic data of a proper denomination and it is possible to improve the coin discriminating efficiency. Further, since the second coin discriminating means reads, based on the image pattern data of the surface of the coin on the side of the transmitting coil of the magnetic sensor, reference magnetic data of a surface of a coin corresponding to the coin surface used by whichever of the first discriminating means or the second discriminating means discriminated the denomination of the coin, thereby discriminating whether or not the coin is acceptable and the denomination of the coin, it is possible to accurately discriminate a counterfeit coin even when optical data acquired from the counterfeit coin, such as diameter data and surface pattern data thereof, coincide with those of coins of a certain denomination and when the magnetic data of the counterfeit coin are similar to those of coins of the denomination.

In a further preferred aspect of the present invention, the image pattern data include data relating to coin diameter and pattern data and the reference optical data include reference data relating to diameters of coins of all denominations and reference pattern data of obverse surfaces and reverse surfaces of coins of all denominations.

In a further preferred aspect of the present invention, the first discriminating means is adapted for comparing the data relating to coin diameter stored in the first pattern data storing means with reference data relating to diameters of coins of all denominations stored in the reference optical data storing means, thereby determining the denomination of the coin, reading the reference pattern data of an obverse surface and a reverse surface of a coin of the thus determined denomination from the reference optical data storing means and comparing them with image pattern data stored in the first pattern data storing means, thereby discriminating whether or not the coin is acceptable and the denomination of the coin, and the second coin discriminating means is adapted for comparing the data relating to coin diameter stored in the second pattern data storing means with reference data relating to diameters of coins of all denominations stored in the reference optical data storing means, thereby determining the denomination of the coin, reading the reference pattern data of an obverse surface and a reverse surface of a coin of the thus determined denomination from the reference optical data storing means and comparing them with the image pattern data stored in the second pattern data storing means, thereby discriminating whether or not the coin is acceptable and the denomination of the coin.

In a further preferred aspect of the present invention, the third discriminating means is adapted for discriminating that the coin is unacceptable when at least one of the first discriminating means and the second discriminating means determines that the coin is unacceptable, discriminating that the coin is unacceptable when the denomination of the coin determined by the first discriminating means and the denomination of the coin determined by the second discriminating means do not coincide with each other, and discriminating that the denomination of the coin coincides with the denomination determined by the first discriminating means and the second discriminating means when the denomination of the coin determined by the first discriminating means and the denomination of the coin determined by the second discriminating means coincide with each other, thereby outputting the denomination to the second coin discriminating means.

The above and other objects and features of the present invention will become apparent from the following description made with reference to the accompanying drawings.

DESCRIPTION OF THE PREFERRED EMBODIMENTS

Figure 1:
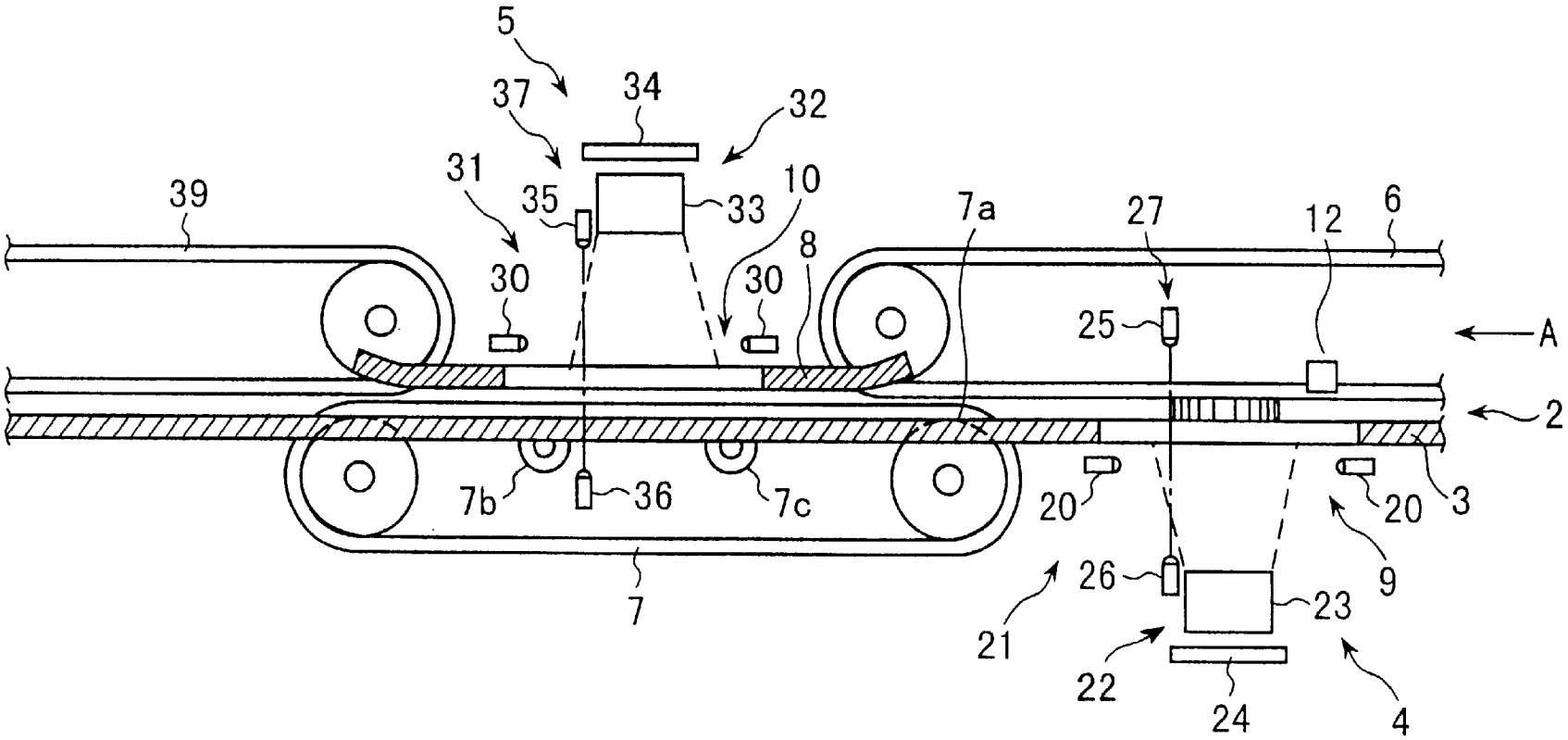
FIG. 1 is a schematic longitudinal cross sectional view of a coin discriminating apparatus which is an embodiment of the present invention.

As shown in FIG. 1, a coin passage 2 through which coins 1 are transported is provided with a coin passage member 3 extending along a transportation direction of coins 1. The coin discriminating apparatus is provided with a first pattern data detection unit 4 and a second pattern data detection unit 5. At the first pattern data detection unit 4, the coin passage 2 is formed by the coin passage member 3 located in the lower portion and a transporting belt 6 constituted by an endless-like round belt located in the upper portion. At the second pattern data detecting unit 5, the coin passage 2 is formed by a transporting belt 7 located to project above the coin passage member 3 from an opening 7*a* formed in the coin passage member 3 and constituted by an endless-like round belt and a coin passage forming member 8 located above the transporting belt 7 and extending in the transportation direction of coins 1.

As shown in FIG. 1, the coin passage member 3 provided with the first pattern data detection unit 4 is formed with a first transparent passage portion 9 made of glass, acrylic resin or the like, and the coin passage forming member 8 is formed with a second transparent passage portion 10 made of glass, acrylic resin or the like.

Figure 2:
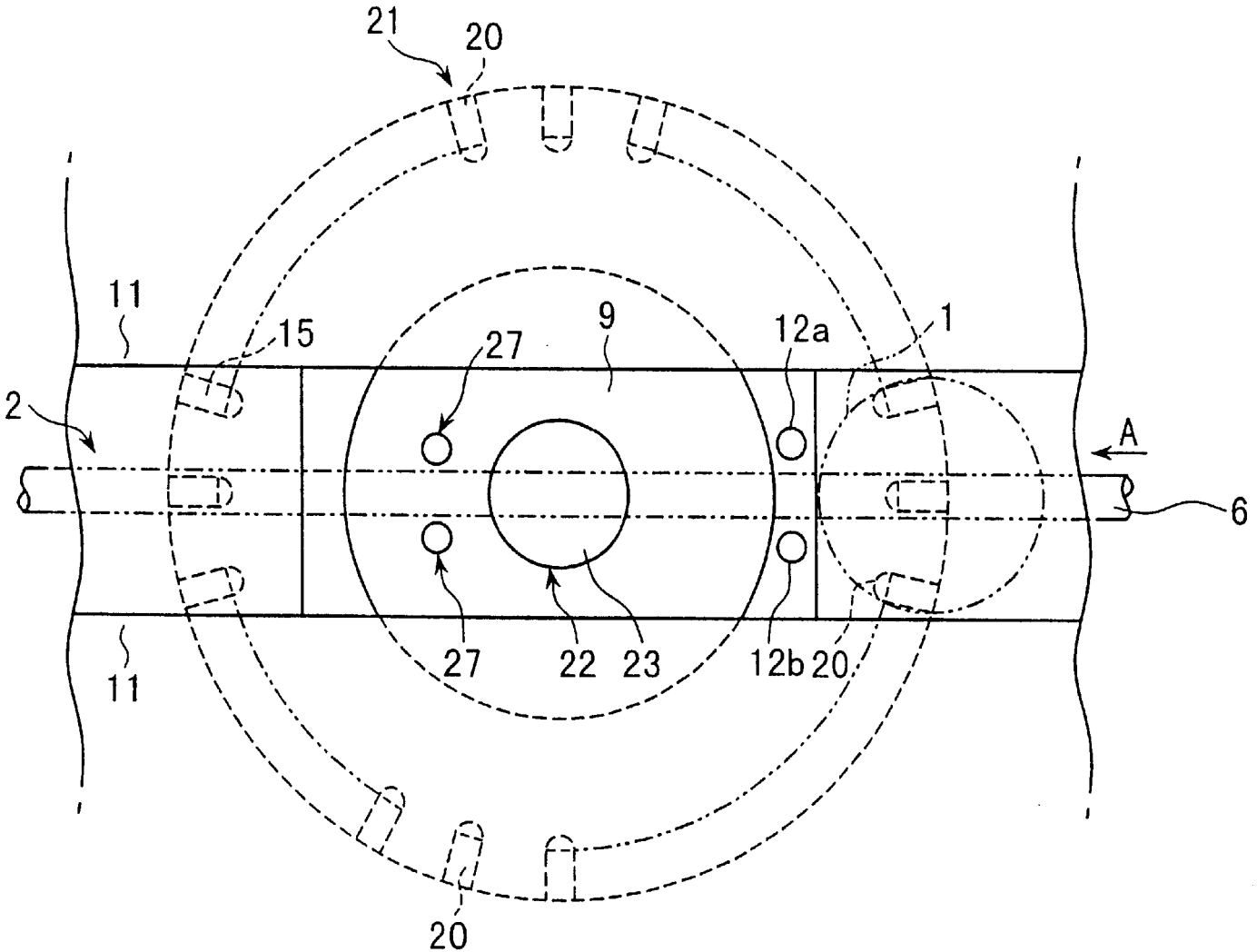
FIG. 2 is a schematic plan view of a first transparent passage portion.

FIG. 2 is a schematic plan view of a first transparent passage portion.

As shown in FIGS. 1 and 2, a coin is fed by the transporting belt 6 located above the coin passage 2 along a pair of guide rails 11, 11 in the direction indicated by an arrow A toward the first transparent passage portion 9 in the coin passage 2. On the upstream side of the first transparent passage portion 9 with respect to the transportation direction of coins 1, a magnetic sensor 12 including transmitting coil 12*a* and receiving coin 12*b* pair is provided for detecting magnetic properties of coins 1 and producing magnetic data of coins 1 in the widthwise direction of the coin passage 2.

At the first transparent passage portion 9, a coin 1 is pressed onto the surface of the first transparent passage portion 9 by a transporting belt 6 and transported in the coin passage 2. Below the first transparent passage portion 9, a first light emitting means 21 including a plurality of light emitting elements 20 is provided for emitting light toward the lower surface of the coin 1 passing through the first transparent passage portion 9 and a first image data producing unit 22 is further provided below the first light emitting means 21 for receiving light emitted from the first light emitting means 21 and reflected by the lower surface of the coin 1 and producing image data. A first pattern data detection unit 4 is constituted by the first light emitting means 21 and the first image data producing unit 22.

As shown in FIG. 2, the first light emitting means 21 is provided with the plurality of light emitting elements 20 such as light emitting diodes (LEDs) disposed on a circle whose center is at the center portion of the first transparent passage portion 9. Each light emitting element 20 is disposed in such a manner that the optical axis thereof is directed at a small angle with respect to the horizontal direction toward a predetermined point on a vertical axis passing through the center of a circle whose center coincides with the center portion of the first transparent passage portion 9, whereby light is projected onto the lower surface of the coin 1 passing through the first transparent passage portion 9 at a shallow angle with respect to the lower surface of the coin 1.

The first image data producing unit 22 includes a lens system 23 disposed so that the optical axis thereof coincides with the vertical axis passing through the center of the circle whose center coincides with the center portion of the first transparent passage portion 9, a CCD area sensor 24 disposed below the lens system 23 so that the focus point thereof is located on the upper surface of the first transparent passage portion 9 and adapted for photoelectrically detecting light emitted from the light emitting elements 20 and reflected by the lower surface of the coin 1, and an A/D converter (not shown) for converting image data of the lower surface of the coin 1 obtained by photoelectrically detecting by the CCD area sensor 24 into digital signals, thereby producing digitized image data of the lower surface of the coin 1.

On the immediately downstream side of the first image data producing unit 22, two sets of timing sensors 27, 27 each of which includes a light emitting element 25 and a light receiving element 26 are provided in the widthwise direction of the coin passage 2 so that light emitted from the light emitting element 25 can be detected through the first transparent passage portion 9 by the light receiving element 26 and each is constituted so as to output a timing signal when the light receiving element 26 does not receive light emitted from the light emitting element 25. Each set of the timing sensors 17 is disposed with respect to the first image data producing unit 22 so that the center of the coin 1 is located at the center of the first transparent passage portion 9 when light emitted from the light emitting element 25 is blocked by the coin 1 being transported on the surface of the first transparent passage portion 9 and is not received by the light receiving element 26, thereby outputting a timing signal.

As shown in FIG. 1, a coin 1 is fed up to the first transparent passage portion 9 and the downstream portion thereof, while it is being pressed onto the upper surface of the coin passage member 3 by the transporting belt 6 located above the coin passage 2. At the downstream portion of the first transparent passage portion 9, a coin 1 comes to be supported by the transporting belt 7 located so as to project above the coin passage member 3 from an opening 7*a* formed in the coin passage member 3 and transported in the coin passage 2, while it is being held between the transporting belt 6 and the transporting belt 7.

As shown in FIG. 1, at the immediately upstream portion of the terminal end portion of the transporting belt 6, the upper surface of a coin 1 comes to be supported by the coin passage forming member 8 and a coin 1 is fed to the second pattern data detection unit 5 in the coin passage 2, while it is being pressed onto the lower surface of the coin passage forming member 8. A plurality of back-up rollers 7*b* and 7*c* are provided for preventing the transporting belt 7 from being deflected downward due to the dead weight of a coin.

The second pattern data detection unit 5 is provided above the second transparent passage portion 10 and includes a second light emitting means 31 provided with a plurality of light emitting elements 30 for projecting light onto the coin 1 passing through the second transparent passage portion 10 and a second image data producing unit 32 disposed above the second transparent passage portion 10 for receiving light emitted from the second light emitting means 31 and reflected by the coin 1 and producing image data. The second light emitting means 31 is constituted in a similar manner to the first light emitting means 7 except that it is disposed above the second transparent passage portion 4 and emits light downwardly and includes the plurality of light emitting elements 30 such as light emitting diodes (LEDs) arranged on the circle whose center coincides with the center portion of the second transparent passage portion 10. Each light emitting element 30 is disposed in such a manner that the optical axis thereof is directed at a small angle with respect to the horizontal direction toward a predetermined point on a vertical axis passing through the center of the circle whose center coincides with the center portion of the second transparent passage portion 4, whereby light is projected onto the upper surface of the coin 1 passing through the second transparent passage portion 10 at a shallow angle with respect to the upper surface of the coin 1.

The second image data producing unit 32 includes a lens system 33 disposed so that the optical axis thereof coincides with the vertical axis passing through the center of the circle whose center coincides with the center portion of the second transparent passage portion 10, a CCD area sensor 34 disposed above the lens system 33 so that the focus point thereof is located on the upper surface of the coin 1 passing through the second transparent passage portion 10 and adapted for photoelectrically detecting light emitted from the light emitting elements 30 and reflected by the surface of the coin 1, and an A/D converter (not shown) for converting image data of the upper surface of the coin 1 obtained by photoelectrically detecting by the CCD area sensor 34 into digital signals, thereby producing digitized image data of the upper surface of the coin 1.

On the immediately downstream side of the second image data producing unit 32, two sets of timing sensors 37, 37 each of which includes a light emitting element 35 and a light receiving element 36 are provided so that light emitted from the light emitting element 35 can be detected through the second transparent passage portion 10 by the light receiving element 36 and each is constituted so as to output a timing signal when the light receiving element 36 does not receive light emitted from the light emitting element 35. Each of the timing sensors 37 is disposed with respect to the second image data producing unit 32 so that the center of the coin 1 is located at the center of the second transparent passage portion 10 when light emitted from the light emitting element 35 is blocked by the coin 1 being transported on the surface of the second transparent passage portion 10 and is not received by the light receiving element 36, thereby outputting a timing signal.

As shown in FIG. 1, a transporting belt 39 extending from the immediately upstream portion of the coin passage forming member 8 toward the downstream portion of the coin passage 2 is provided. After a coin 1 has passed through the second transparent passage portion 10, the coin 1 is held between the transporting belt 7 and the transporting belt 39, and is then held between the transporting belt 39 and the coin passage member 3, thereby being transported downstream in the coin passage 2.

Figure 3:
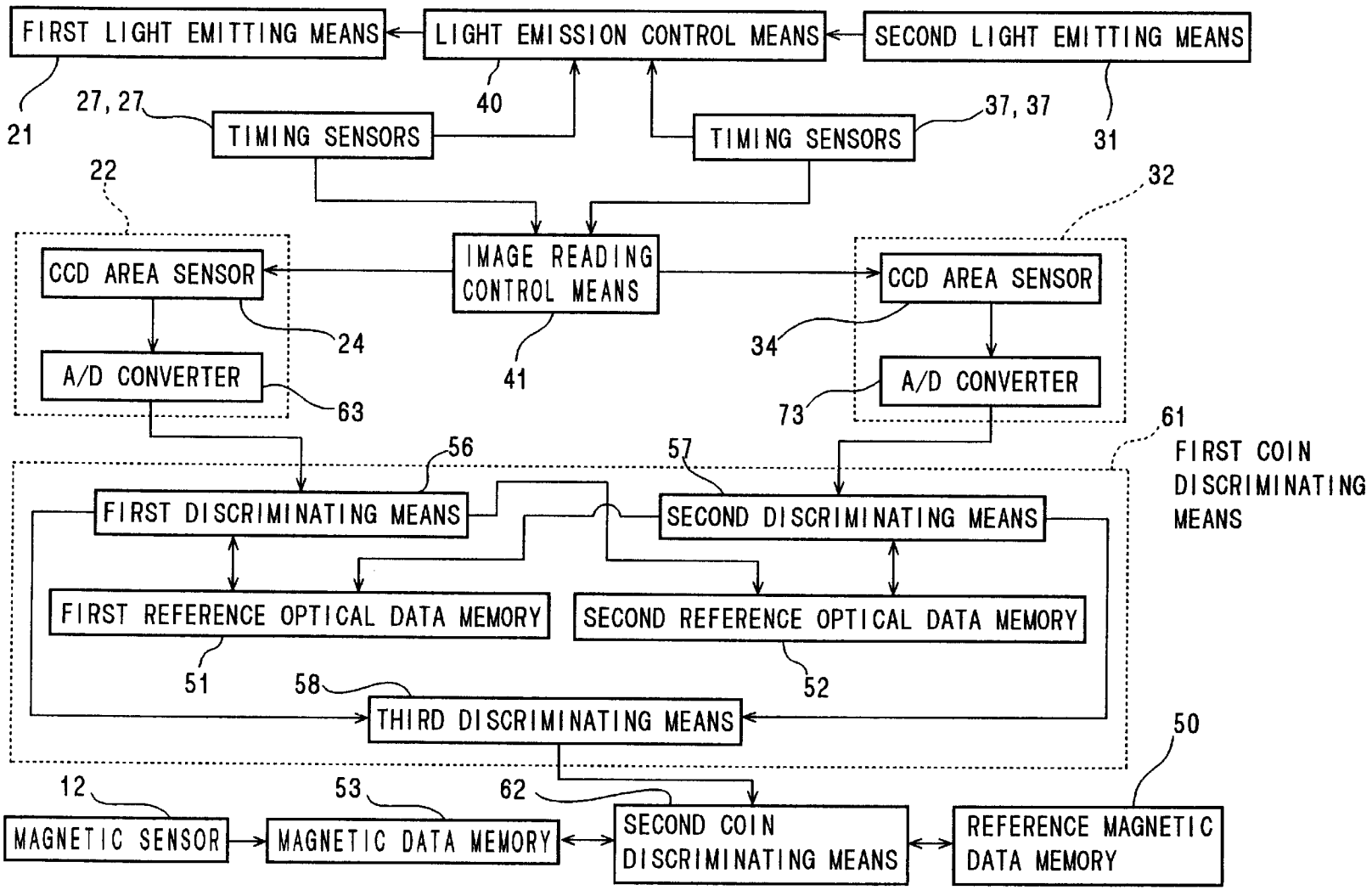
FIG. 3 is a block diagram of detection, control, memory and discrimination systems of a coin discriminating apparatus which is an embodiment of the present invention.

FIG. 3 is a block diagram of detection, control, memory and discrimination systems of a coin discriminating apparatus which is an embodiment of the present invention.

As shown in FIG. 3, the detection system of the coin discriminating apparatus includes the two sets of timing sensors 27, 27 for detecting a coin 1 fed to the first transparent passage portion 9 and the two sets of timing sensors 37, 37 for detecting a coin fed to the second transparent passage portion 10.

As shown in FIG. 3, the detection system of the coin discriminating apparatus further includes the magnetic sensor 12 comprising the transmitting coil 12*a* and receiving coil 12*b* pair for detecting magnetic properties of a coin 1 and producing magnetic data of the coin 1, the CCD area sensor 24 for receiving light reflected by the lower surface of a coin 1 and producing image pattern data of the lower surface of the coin 1, and the CCD area sensor 34 for receiving light reflected by the upper surface of a coin 1 and producing image pattern data of the upper surface of the coin 1. In FIG. 3, the reference numeral 63 designates an A/D converter for digitizing analog image pattern data of a coin 1 produced by the CCD area sensor 24 and the reference numeral 73 designates an A/D converter for digitizing analog image pattern data of a coin 1 produced by the CCD area sensor 34.

As shown in FIG. 3, the control system of the coin discriminating apparatus includes light emission control means 40 which outputs a light emission signal to the first light emitting means 21 when the timing signal from the timing sensors 27, 27 is received and causes it to emit light and illuminate the coin 1 located on the upper surface of the first transparent passage portion 9 and outputs a light emission signal to the second light emitting means 31 when the timing signal from the timing sensors 37, 37 is received and causes it to emit light and illuminate the coin 1 located on the upper surface of the second transparent passage portion 10, and image reading control means 41 for permitting the CCD area sensor 24 of the first image data producing unit 22 to start detecting the light reflected from the surface of the coin 1 when the timing signal from the timing sensors 27, 27 is received and permitting the CCD area sensor 34 of the second image data producing unit 32 to start detecting the light reflected from the surface of the coin 1 when the timing signal from the timing sensors 37, 37 is received.

As shown in FIG. 3, the memory system of the coin discriminating apparatus includes a reference magnetic data memory 50 for storing reference magnetic data indicating magnetic properties of the observe and reverse surfaces of all denominations of coins, a first reference optical data memory 51 for storing reference data relating to diameters of all denominations of coins, and a second reference optical data memory 52 for storing reference ratio data indicating the ratio of data "0" in the binary image pattern data groups corresponding to a plurality of annular areas on the obverse and reverse surfaces of all denominations of coins 1.

As shown in FIG. 3, the memory system of the coin discriminating apparatus includes a magnetic data memory 53 for storing magnetic data of a coin 1 produced by the magnetic sensor 12.

As shown in FIG. 3, the discriminating system of the coin discriminating apparatus includes a first coin discriminating means 61 including a first discriminating means 56 for discriminating, based on image pattern data of the lower surface of a coin 1 produced by the first image data producing unit 22, whether or not the coin 1 is acceptable and the denomination of the coin 1 and whether the lower surface of the coin 1 is an obverse surface or a reverse surface of the coin 1, a second discriminating means 57 for discriminating, based on image pattern data of the upper surface of a coin 1 produced by the second image data producing unit 32, whether or not the coin 1 is acceptable and the denomination of the coin 1 and whether the upper surface of the coin 1 is an obverse surface or a reverse surface of the coin 1, a third discriminating means 58 for determining based on the results of discrimination made by the first discriminating means 56 and the second discriminating means 57 that the denomination of a coin 1 coincides with the denomination discriminated by the first discriminating means 56 and the second discriminating means 57 when the denomination of the coin 1 discriminated by the first discriminating means 56 coincides with that discriminated by the second discriminating means 57 and discriminating that a coin 1 is unacceptable when the denomination of the coin 1 discriminated by the first discriminating means 56 does not coincide with that discriminated by the second discriminating means 57, and a second coin discriminating means 62 for reading from the reference magnetic data memory 50 reference magnetic data corresponding to the denomination of the coin discriminated by the third discriminating means 58 of the first coin discriminating means 61 and corresponding to the denomination whose obverse surface or reverse surface reference pattern data were used by whichever of the first discriminating means 56 and the second discriminating means 57 discriminated based on the image pattern data of the surface of the coin 1 on the side of the transmitting coil 12*a* of the magnetic sensor 12 that the coin 1 was acceptable and what the denomination of the coin 1 was and comparing them with the magnetic data of the coin 1 produced by the magnetic sensor 12, thereby finally determining whether or not the coin 1 is acceptable and the denomination of the coin 1.

Figure 4:
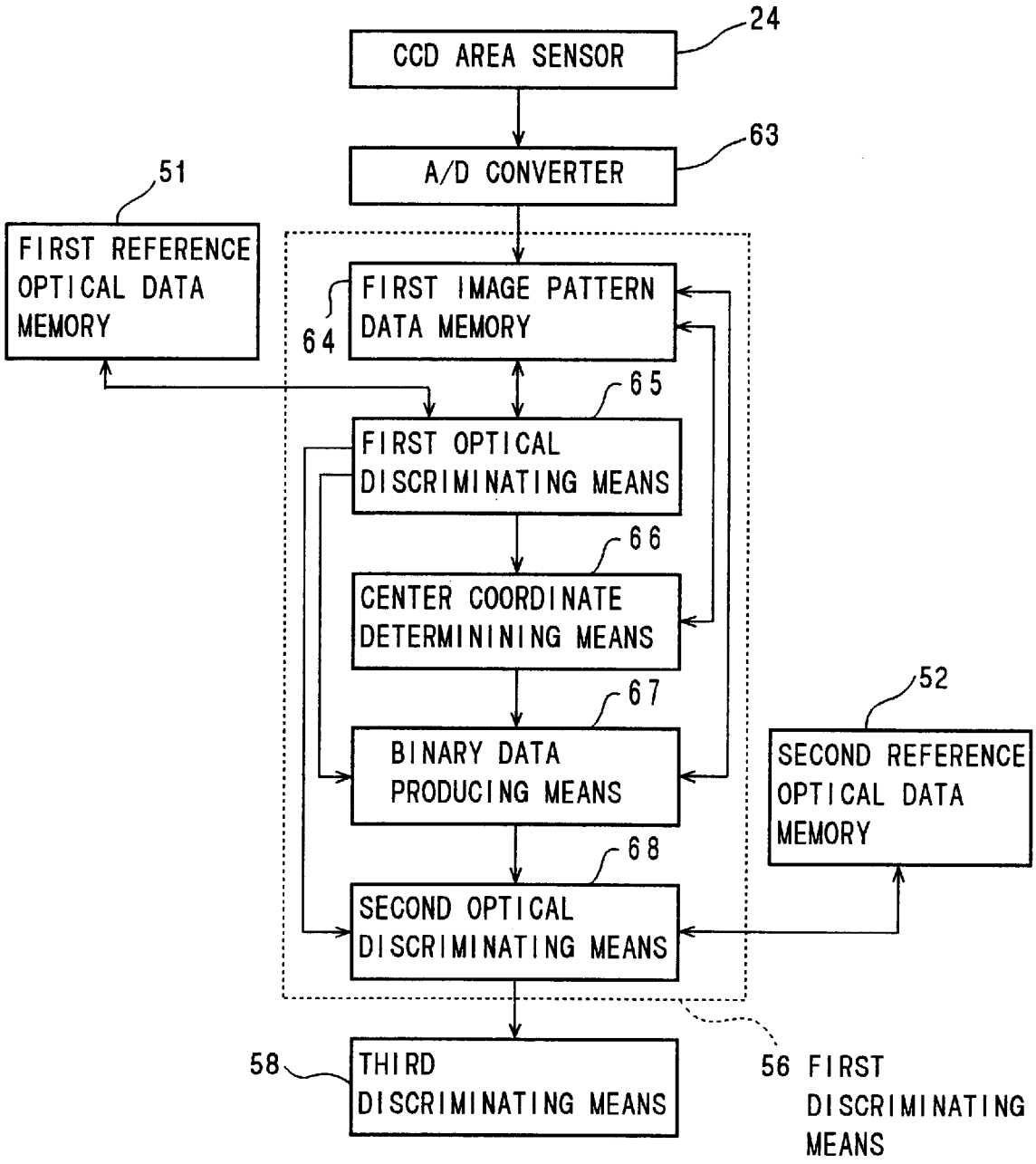
FIG. 4 is a block diagram of a first discriminating means.

FIG. 4 is a block diagram of the first discriminating means 56.

As shown in FIG. 4, the first discriminating means 56 includes a first image pattern data memory 64 for mapping and storing the image pattern data of the lower surface of the coin 1 photoelectrically detected by the CCD area sensor 24 of the first image data producing unit 22 and digitized by the A/D converter 63 into an orthogonal coordinate system, i.e., an x-y coordinate system; first optical discriminating means 65 for reading the reference data relating to the diameter of the coin of each denomination stored in the first reference optical data memory 51 and comparing them with the image pattern data of the coin 1 stored in the first image pattern data memory 64, thereby discriminating whether or not the coin 1 is acceptable and the denomination of the coin 1; a center coordinate determining means 66 for obtaining the center coordinates of the image pattern data of the coin 1 mapped and stored in the first image pattern data memory 64; a binary data producing means 67 which binarizes the image pattern data of the coin 1 mapped and stored in the first image pattern data memory 64 and groups the binarized image pattern data into binary image pattern data groups corresponding to a plurality of annular areas of the obverse or reverse surface of the coin 1 determined for each denomination based on the result of discrimination made by the first optical discriminating means 65, obtains the number of "0" data in the binary image pattern data groups corresponding to each annular area, further obtains the ratio of the "0" data in the entire data, thereby producing ratio data for each binary image pattern data group corresponding to each annular area of the obverse or reverse surface of the coin 1; and a second optical discriminating means 68 which accesses the second reference optical data memory 52 based on the result of discrimination made by the first optical discriminating means 65, reads reference ratio data that indicate the ratio of the "0" data in the binary image pattern data groups corresponding to the plurality of annular areas of the obverse or reverse surface of the coin 1 having the denomination discriminated by the first optical discriminating means 65, and compares them with the ratio data in the binary image pattern data groups corresponding to each annular area of he obverse or reverse surface of the coin 1 input from the binary data producing means 67, thereby determining whether or not the coin 1 is acceptable, the denomination of the coin 1 and whether the lower surface of the coin 1 is an obverse surface or a reverse surface.

Figure 5:
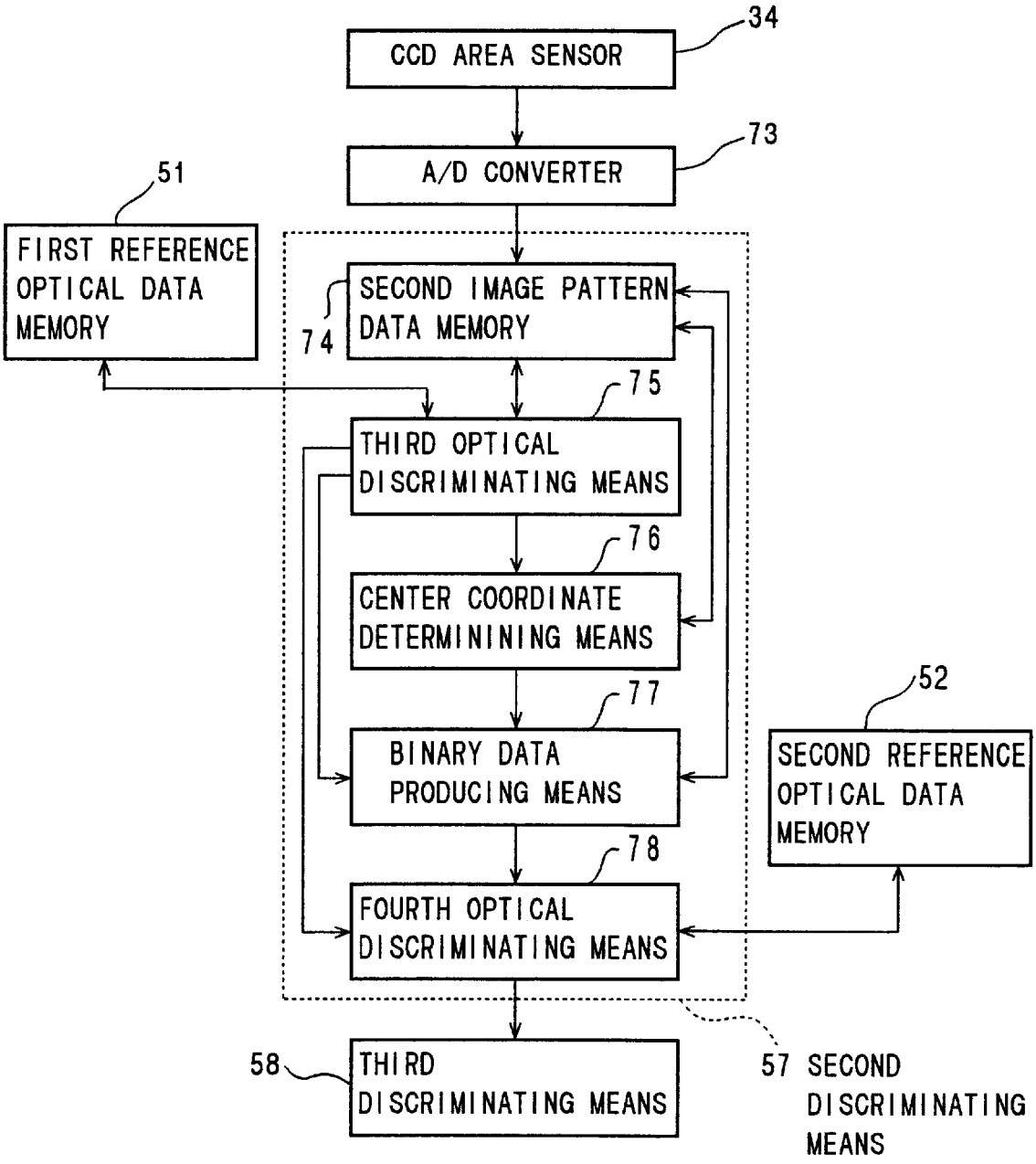
FIG. 5 is a block diagram of a second discriminating means.

FIG. 5 is a block diagram of the second discriminating means 57.

As shown in FIG. 5, the second discriminating means 57 includes a second image pattern data memory 74 for mapping and storing the image pattern data of the upper surface of the coin 1 photoelectrically detected by the CCD area sensor 34 of the second image data producing unit 32 and digitized by the A/D converter 73 into an orthogonal coordinate system, i.e., an x-y coordinate system; third optical discriminating means 75 for reading the reference data relating to the diameter of the coin of each denomination stored in the first reference optical data memory 51 and comparing them with the image pattern data of the coin 1 stored in the second image pattern data memory 74, thereby discriminating whether or not the coin is acceptable and the denomination of the coin 1; a center coordinate determining means 76 for obtaining the center coordinates of the image pattern data of the coin 1 mapped and stored in the second image pattern data memory 74; a binary data producing means 77 which binarizes the image pattern data of the coin 1 mapped and stored in the second image pattern data memory 74 and groups the binarized image pattern data into binary image pattern data groups corresponding to a plurality of annular areas of the obverse or reverse surface of the coin 1 determined for each denomination based on the result of discrimination made by the third optical discriminating means 75, obtains the number of "0" data in the binary image pattern data groups corresponding to each annular area, further obtains the ratio of the "0" data in the entire data, thereby producing ratio data for each binary image pattern data group corresponding to each annular area of the obverse or reverse surface of the coin 1; and a fourth optical discriminating means 78 which accesses the second reference optical data memory 52 based on the result of discrimination made by the third optical discriminating means 75, reads reference ratio data that indicate the ratio of the "0" data in the binary image pattern data groups corresponding to the plurality of annular areas of the obverse or reverse surface of the coin 1 having the denomination discriminated by the third optical discriminating means 75, and compares them with the ratio data in the binary image pattern data groups corresponding to each annular area of the obverse or reverse surface of the coin 1 input from the binary data producing means 77, thereby determining whether or not the coin 1 is acceptable, the denomination of the coin 1 and whether the upper surface of the coin 1 is an obverse surface or a reverse surface.

The thus constituted coin discriminating apparatus according to the embodiment of the present invention discriminates whether or not a coin 1 is acceptable and the denomination of the coin 1.

A coin 1 is fed along the pair of guide rails 11, 11 in the coin passage 2 in the direction indicated by an arrow A, while it is being pressed onto the surface of the coin passage 2 by the transporting belt 6 and magnetic properties of the coin 1 are detected by the magnetic sensor 12, thereby producing magnetic data. The thus produced magnetic data are stored in the magnetic data memory 53.

When the coin 1 is further fed in the coin passage 2 and blocks light emitted from the light emitting element 25 of each timing sensor 27, whereby the two sets of the timing sensors 27, 27 detect the coin 1, timing signals are output from the timing sensor 27 to the light emission control means 40 and the image reading control means 41.

When the timing signals are input from the timing sensors 27, 27, the light emission control means 40 outputs a light emission signal to the first light emitting means 21 and causes the light emitting elements 20 to emit light toward the lower surface of the coin 1 located on the first transparent passage portion 9.

When the timing signals are input from the timing sensors 27, 27, the image reading control means 41 causes the CCD area sensor 24 of the first image data producing unit 22 to detect light emitted from the light emitting elements 20 and reflected by the lower surface of the coin 1.

Since the light emitting elements 20 are disposed so as to be able to illuminate the coin 1 which advances on the first transparent passage portion 9 at a shallow angle, the light is reflected according to the raised and depressed pattern of the lower surface of the coin 1. The light reflected from the surface of the coin 1 is directed toward the CCD area sensor 24 by the lens system 23 and photoelectrically detected by the CCD area sensor 24, whereby the image pattern data of the lower surface of the coin 1 are produced by the CCD area sensor 24. The image pattern data of the lower surface of the coin 1 produced by the CCD area sensor 24 are digitized by the A/D converter 63. The digitized image pattern data are mapped and stored in the orthogonal coordinate system, namely, x-y coordinate system in the first image pattern data memory 64.

When the image pattern data of the lower surface of the coin 1 are stored in the first image pattern data memory 64, the first optical discriminating means 65 accesses the first reference optical data memory 51. It reads the data stored in the first reference optical data memory 51 with regard to the diameter of the coin 1 and also the image pattern data stored in the first image pattern data memory 64. By comparing those data, the first optical discriminating means 65 determines the denomination of the coin 1 and outputs the result of the discrimination to the second optical discriminating means 68.

On the other hand, the center coordinate determining means 66 determines the center coordinate of the image pattern data mapped and stored in the orthogonal coordinate system, namely, the x-y coordinate system and stored in the first image pattern data memory 64 and outputs the center coordinate to the binary data producing means 67.

The binary data producing means 67 reads the image pattern data of the lower surface of the coin 1 mapped and stored in the first image pattern data memory 64 and binarizes them. The binary data producing means 67 groups the binarized image pattern data into the binary image pattern data groups of the denomination corresponding to the plurality of annular areas of the surface of the coin 1 based on the result of the discrimination made by the first optical discriminating means 65 and the center coordinate input from the center coordinate determining means 66. The binary data producing means 67 further obtains the number of the "0" data in each binary image pattern data group corresponding to each annular area, obtains the ratio of the "0" data with respect to all the data, produces the ratio data of each binary image pattern data group corresponding to each annular area of the surface of the coin 1 and outputs the ratio data to the second optical discriminating means 68.

When the ratio data of each binary image pattern data group are input from the binary data producing means 67, the second optical discriminating means 68 accesses the second reference optical data memory 52, reads the reference ratio data of the reverse surface of a coin having the denomination corresponding to that determined by the first optical discriminating means 65 from among the reference ratio data stored in the second reference optical data memory 52, and compares them with the ratio data input from the binary data producing means 67, thereby discriminating the denomination of the coin 1.

When the denomination of the coin 1 is discriminated, the second optical discriminating means 68 calculates the absolute value Di (i=1 to n, n is the number of annular areas of the coin 1 which are predetermined for each denomination) of the difference between the reference ratio data of each binary image pattern group corresponding to each annular area of the coin 1 and the ratio data input from the binary data producing means 67. The second optical discriminating means 68 then determines whether or not the absolute values Di of the differences between the reference ratio data of each binary image pattern group corresponding to each annular area of the coin 1 and the ratio data input from the binary data producing means 67 are less than a predetermined value D0. As a result, when the absolute values Di of the differences between the reference ratio data of binary image pattern groups corresponding to all annular areas of the coin 1 and the ratio data input from the binary data producing means 67 are less than a predetermined value D0, the second optical discriminating means 68 further integrates the absolute values Di of the differences between the reference ratio data and the ratio data over all of the binary image pattern data groups corresponding to the annular areas of the coin 1, and determines whether or not the resulted integrated value I is less than a predetermined value I0. As a result, when the integrated value I is less than the predetermined value I0, the second optical discriminating means 68 determines that the coin 1 is the coin of the denomination determined by the first optical discriminating means 65. Now, it should be noted that if the denomination of the coin 1 coincides with the denomination determined by the first optical discriminating means 65, theoretically, the absolute value Di and the integrated value I become 0. However, because the surface of the coin 1 may be worn out or a detecting error may exist, they may not be equal to 0 even if the determined denominations coincide. Therefore, in this embodiment, when Di is less than D0 and, at the same time, I is less than I0, it is determined that the coin 1 is the coin of the denomination determined by the first optical discriminating means 65.

To the contrary, when at least one absolute value Di of the differences between the reference ratio data of the binary image pattern data group corresponding to at least one of annular areas of the coin 1 and the ratio data input from the binary data producing means 67 are not less than the predetermined value D0, or when the absolute values Di of the differences between the reference ratio data of all binary image pattern data groups corresponding to all annular areas of the coin 1 and the ratio data are less than the predetermined value D0 and at the same time, the integrated value I is not less than the predetermined value I0, the second optical discriminating means 68 cannot determine that the denomination of the coin 1 is same as the denomination determined by the first optical discriminating means 65. However, the coin 1 cannot be always fed such that its obverse surface faces upward and there are cases where the obverse surface of the coin 1 faces downward while it is advanced in the coin passage 2. As a result, there is a possibility that the surface pattern of the obverse surface of the coin 1 may be detected by the CCD area sensor 24. Therefore, to determine that the coin 1 is not acceptable when the ratio data of the coin 1 input from the binary data producing means 67 do not coincide with the reference ratio data of the reverse surface of the coin of the denomination determined by the first optical discriminating means 65 will significantly lower discriminating accuracy.

Thus, the second optical discriminating means 68 further accesses the second reference optical data memory 52, reads the reference ratio data of the obverse surface of the coin of the denomination determined by the first optical discriminating means 65, and, in the exactly same manner as described above, it determines whether or not the absolute values Di of the differences between the reference ratio data of each binary image pattern group corresponding to each annular area of the coin 1 and the ratio data input from the binary data producing means 67 are less than a predetermined value D0. When the absolute values Di of the differences between the reference ratio data of all the binary image pattern groups corresponding to each annular area of the coin 1 and the ratio data are less than a predetermined value D0, the second optical discriminating means 68 integrates the absolute values Di of the differences between the reference ratio data of all the binary image pattern groups corresponding to each annular area of the coin 1 and the ratio data, and determines whether or not the resulted integrated value I is less than the predetermined value I0. As a result, when the integrated value I is less than the predetermined value I0, the second optical discriminating means 68 determines that the coin 1 is the coin of the denomination determined by the first optical means 65.

On the other hand, when at least one of absolute values Di of the differences between the reference ratio data of the binary image pattern groups corresponding to each annular area of the obverse surface of the coin 1 and the ratio data input from the binary data producing means 67 are not less than a predetermined value D0, or when the absolute values Di of the differences between the reference ratio data of the binary image pattern groups corresponding to all annular areas of the obverse surface of the coin 1 and the detected ratio data are less than a predetermined value D0 and at the same time, the integrated value I is not less than the predetermined value I0, it means that, as a result of comparing the reference ratio data of the coin of the denomination whose magnetic properties and diameter are closest among the denominations with the detected ratio data, the surface patterns of the obverse surface and the reverse surface of the coin 1 are different from the surface patterns of the coin of the denomination determined by the first optical discriminating means 65. Therefore, since the coin 1 is either a counterfeit coin or a foreign coin and the second optical discriminating means 68 determines that the coin 1 is unacceptable. The second optical discriminating means 68 of the first discriminating means 56 outputs with to the third discriminating means 58 as a first discrimination signal the result of discrimination as to whether or not the coin 1 is acceptable, the denomination of the coin 1 when the coin 1 is acceptable and with which of the obverse surface reference ratio data and the reverse surface reference ratio data the detected ratio data of the coin 1 coincides.

Thus, when the pattern data of the lower surface of the coin 1 are detected by the first pattern data detection unit 4, the coin 1 is further fed downstream in the coin passage 2 by the transporting belt 6 and the lower surface thereof is supported by the transporting belt 7 disposed so as to project above the coin passage member 3 from the opening 7*a* formed in the coin passage member 3. As a result, the coin 1 is held between the transporting belt 6 and the transporting belt 7 to be transported and it is then fed to the second transparent passage portion 10 while it is being pressed onto the lower surface of the coin passage forming member 8.

When the coin 1 is fed in the coin passage 2 to the second transparent passage portion 10 and blocks light emitted from the light emitting element 35 of each timing sensor 37, whereby the two sets of the timing sensors 37, 37 detect the coin 1, timing signals are output from the timing sensor 37 to the light emission control means 40 and the image reading control means 41.

When the timing signals are input from the timing sensors 37, 37, the light emission control means 40 outputs a light emission signal to the second light emitting means 31 and causes the light emitting elements 30 to emit light toward the upper surface of the coin 1 located on the second transparent passage portion 10.

When the timing signals are input from the timing sensors 37, 37, the image reading control means 41 causes the CCD area sensor 34 of the second image data producing unit 32 to detect light emitted from the light emitting elements 30 and reflected by the upper surface of the coin 1.

Since the light emitting elements 30 are disposed so as to be able to illuminate the coin 1 which advances on the second transparent passage portion 10 at a shallow angle, the light is reflected according to the raised and depressed pattern of the upper surface of the coin 1. The light reflected from the surface of the coin 1 is directed toward the CCD area sensor 34 by the lens system 33 and photoelectrically detected by the CCD area sensor 34, whereby the image pattern data of the upper surface of the coin 1 are produced by the CCD area sensor 34. The image pattern data of the upper surface of the coin 1 produced by the CCD area sensor 34 are digitized by the A/D converter 73. The digitized image pattern data are mapped and stored in the orthogonal coordinate system, namely, x-y coordinate system in the second image pattern data memory 74.

When the image pattern data of the upper surface of the coin 1 are stored in the second image pattern data memory 74, the third optical discriminating means 75 of the second discriminating means 57 accesses the first reference optical data memory 51. It reads the data stored in the with regard to the diameter of the coin 1 and also the image pattern data stored in the first image pattern data memory 74. By comparing those data, the third optical discriminating means 75 determines the denomination of the coin 1 and outputs the result of the discrimination to the fourth optical discriminating means 78.

On the other hand, the center coordinate determining means 76 determines the center coordinate of the image pattern data mapped and stored in the orthogonal coordinate system, namely, the x-y coordinate system and stored in the second image pattern data memory 74 and outputs the center coordinate to the binary data producing means 77.

The binary data producing means 77 reads the image pattern data of the upper surface of the coin 1 mapped and stored in the second image pattern data memory 74 and binarizes them. The binary data producing means 77 groups the binarized image pattern data into the binary image pattern data groups of the denomination corresponding to the plurality of annular areas of the surface of the coin 1 based on the result of the discrimination input from the third optical discriminating means 75 and the center coordinate input from the center coordinate determining means 76. The binary data producing means 77 further obtains the number of the "0" data in each binary image pattern data group corresponding to each annular area, obtains the ratio of the "0" data with respect to all the data, produces the ratio data of each binary image pattern data group corresponding to each annular area of the surface of the coin 1 and outputs the ratio data to the fourth optical discriminating means 78.

When the ratio data of the binary image pattern data groups are input from the binary data producing means 77, the fourth optical discriminating means 78 accesses the second reference optical data memory 52, reads the reference ratio data of both surfaces of a coin whose denomination corresponds to that determined by the third optical discriminating means 75 from among the reference ratio data stored in the second reference optical data memory 52, and compares them with the ratio data input from the binary data producing means 77, thereby discriminating whether or not the coin 1 is acceptable and the denomination of the coin 1 in the exactly same manner as the second optical discriminating means 68 of the first discriminating means 56.

The fourth optical discriminating means 78 accesses the second reference optical data memory 52, reads the reference ratio data of both surfaces of a coin having the denomination determined by the third optical discriminating means 75 in accordance with the result of discrimination made by the third optical discriminating means 75 from among the reference ratio data stored in the second reference optical data memory 52, and compares them with the ratio data input from the binary data producing means 77, thereby discriminating whether or not the coin 1 is acceptable and the denomination of the coin 1 in the exactly same manner as the second optical discriminating means 68 of the first discriminating means 56.

The fourth optical discriminating means 78 of the second discriminating means 57 outputs to the third discriminating means 58 as a second discrimination signal the result of discrimination as to whether or not the coin 1 is acceptable, the denomination of the coin 1 when the coin 1 is acceptable and with which of the obverse surface reference ratio data and the reverse surface reference ratio data the detected ratio data of the coin 1 coincides.

The third discriminating means 58 first discriminates whether the coin 1 has been discriminated to be acceptable based on the first discrimination signal input from the second optical discriminating means 68 of the first discriminating means 56 and the second discrimination signal input from the fourth optical discriminating means 78 of the second discriminating means 57.

When at least one of the second optical discriminating means 68 of the first discriminating means 56 and the fourth optical discriminating means 78 of the second discriminating means 57 has discriminated the coin 1 to be unacceptable, the third discriminating means 58 discriminates the coin 1 to be unacceptable.

Even if both the second optical discriminating means 68 of the first discriminating means 56 and the fourth optical discriminating means 78 of the second discriminating means 57 discriminated the coin 1 to be acceptable, when the denomination of the coin 1 determined by the second optical discriminating means 68 of the first discriminating means 56 and that determined by the fourth optical discriminating means 78 of the second discriminating means 57 do not coincide, the third discriminating means 58 discriminates the coin 1 to be unacceptable.

To the contrary, when both the second optical discriminating means 68 of the first discriminating means 56 and the fourth optical discriminating means 78 of the second discriminating means 57 discriminated the coin 1 to be acceptable and when the denomination of the coin 1 determined by the second optical discriminating means 68 of the first discriminating means 56 and the denomination of the coin 1 determined by the fourth optical discriminating means 78 of the second discriminating means 57 coincide, the third discriminating means 58 judges, based on the first discrimination signal input from the second optical discriminating means 68 of the first discriminating means 56 and the second discrimination signal input from the fourth optical discriminating means 78 of the second discriminating means 57, whether the second optical discriminating means 68 of the first discriminating means 56 determined the coin 1 to be acceptable based on the obverse surface reference ratio data or the reverse surface reference ratio data of a coin of the denomination, and whether the fourth optical discriminating means 78 of the second discriminating means 57 determined the coin 1 to be acceptable based on the obverse surface reference ratio data or the reverse surface reference ratio data of a coin of the denomination.

When the second optical discriminating means 68 of the first discriminating means 56 and the fourth optical discriminating means 78 of the second discriminating means 57 determined the coin 1 to be acceptable based on the reference ratio data of the same surface of a coin of the denomination, the third discriminating means 58 discriminates the coin 1 to be unacceptable.

To the contrary, when the second optical discriminating means 68 of the first discriminating means 56 and the fourth optical discriminating means 78 of the second discriminating means 57 determined the coin 1 to be acceptable based on the reference ratio data of different surfaces of a coin 1 of the denomination, the third discriminating means 58 outputs the denomination determined by the second optical discriminating means 68 of the first discriminating means 56 and the fourth optical discriminating means 78 of the second discriminating means 57 to the second coin discriminating means 62 as a denomination discrimination signal and judges, in accordance with the first discrimination signal input from the second optical discriminating means 68 of the first discriminating means 56 or the second discrimination signal input from the second optical discriminating means 68 of the first discriminating means 56 or the second discrimination signal input from the fourth optical discriminating means 78 of the second discriminating means 57, which surface reference ratio data of a coin of the denomination was used by whichever of the first discriminating means 56 and the second discriminating means 57 discriminated the coin 1 to be acceptable based on image pattern data of the surface of the coin 1 on the side of the transmitting coil 12*a* of the magnetic sensor 12, thereby outputting a surface determination signal to the second coin discriminating means 62.

In this embodiment, the second image data producing unit 32 produced the image pattern data of the surface of the coin 1 on the side of the transmitting coil 12*a* of the magnetic sensor 12 and the fourth optical discriminating means 78 of the second discriminating means 57 made the discrimination of the coin 1 based on the image pattern data of the coin 1 of this surface. Therefore, the third discriminating means 58 judges which surface reference ratio data of a coin of the denomination was used by the fourth optical discriminating means 78 of the second discriminating means 57 to discriminate the coin 1 to be acceptable and outputs the surface determination signal to the second coin discriminating means 62.

Based on the denomination discrimination signal and the surface determination signal input from the third discriminating means 58, the second coin discriminating means 62 reads out the reference magnetic data of the obverse surface or the reverse surface of a coin of the denomination discriminated by the third discriminating means 58 from the reference magnetic data memory 50, reads out the magnetic data of the coin 1 produced by detecting magnetic properties of the coin 1 by the magnetic sensor 12 and stored in the magnetic data memory 53, and compares the two sets of data.

When the second coin discriminating means 62 judges with reference to the predetermined threshold value that the reference magnetic data of the surface of a coin of the denomination and the magnetic data of the coin 1 do not coincide, it finally discriminates the coin to be unacceptable.

To the contrary, when the second coin discriminating means 62 judges with reference to the predetermined threshold value that the reference magnetic data of the surface of a coin of the denomination and the magnetic data of the coin 1 coincide, it finally discriminates that the denomination of the coin 1 coincides with that discriminated by the third discriminating means 58.

Thus, coins discriminated to be unacceptable are sorted and collected separately from coins discriminated to be acceptable.

According to the above described embodiment, the first image data producing unit 22 produces the image pattern data of one surface of a coin 1 and the second image data producing unit 32 produces the image pattern data of the other surface of the coin 1. The first discriminating means 56 of the first coin discriminating means 61 compares the image pattern data of the one surface of the coin 1 and the reference ratio data of the obverse and reverse surfaces of coins of each denomination and determines whether or not the coin 1 is acceptable, and the denomination of the coin 1 when the coin 1 is acceptable and the second discriminating means 57 of the first coin discriminating means 61 compares the image pattern data of the other surface of the coin 1 and the reference ratio data of the obverse and reverse surfaces of coins of each denomination and determines whether or not the coin 1 is acceptable and the denomination of the coin 1 when the coin 1 is acceptable. When the denomination of the coin 1 determined by the first discriminating means 56 and that of the coin 1 determined by the second discriminating means 57, the third discriminating means 58 outputs the denomination of the coin 1 to the second coin discriminating means 62 as a denomination determination signal, and judges, in accordance with the first discrimination signal input from the second optical discriminating means 68 or the second discrimination signal input from the fourth optical discriminating means 78, which surface reference ratio data of a coin of the denomination was used by the second discriminating means 57 the one of the first discriminating means 56 and the second discriminating means 57 that determined the coin 1 based on the image pattern data of the surface of a coin 1 on the side of the transmitting coil 12*a* of the magnetic sensor 12 to discriminate the coin 1 to be acceptable, thereby outputting a surface determination signal to the second coin discriminating means 62. Based on the denomination discrimination signal and the surface determination signal input from the third discriminating means 58, the second coin discriminating means 62 reads out the reference ratio data of the obverse surface or the reverse surface of a coin of the denomination discriminated by the third discriminating means 58 from the reference magnetic data memory 50, reads out the magnetic data of the coin 1 produced by detecting magnetic properties of the coin 1 by the magnetic sensor 12 and stored in the magnetic data memory 53, and compares the two sets of data, thereby finally discriminating whether or not the coin 1 is acceptable and the denomination of the coin 1 when the coin 1 is acceptable. Therefore, since the first coin discriminating means 61 discriminates whether or not the coin 1 is acceptable and the denomination of the coin 1 based on the image pattern data of both surfaces of the coin 1 and the second coin discriminating means 62 reads out, based on the denomination of the coin 1 determined by the third discriminating means 58, the reference ratio data of a coin from the reference magnetic data memory 50, the second coin discriminating means 62 can discriminate whether or not the coin 1 is acceptable and the denomination of the coin 1 based on the reference magnetic data of a proper denomination, thereby improving the discrimination accuracy of coins. Further, based on the image pattern data of the surface of the coin 1 on the side of the transmitting coil 12*a* of the magnetic sensor 12, the second coin discriminating means 62 reads out from the reference magnetic data memory 50 the reference magnetic data corresponding to the surface of a coin of the reference optical data employed by the second discriminating means 57, which determined the denomination of the coin 1 and discriminates whether or not the coin 1 is acceptable and the denomination of the coin 1. Therefore, even when image pattern data of a counterfeit coin coincides with image pattern data of a coin of a certain denomination and the magnetic properties of the counterfeit coin are similar to those of the denomination of the coin, it is possible to discriminate the counterfeit coin with high accuracy.

Figure 6:
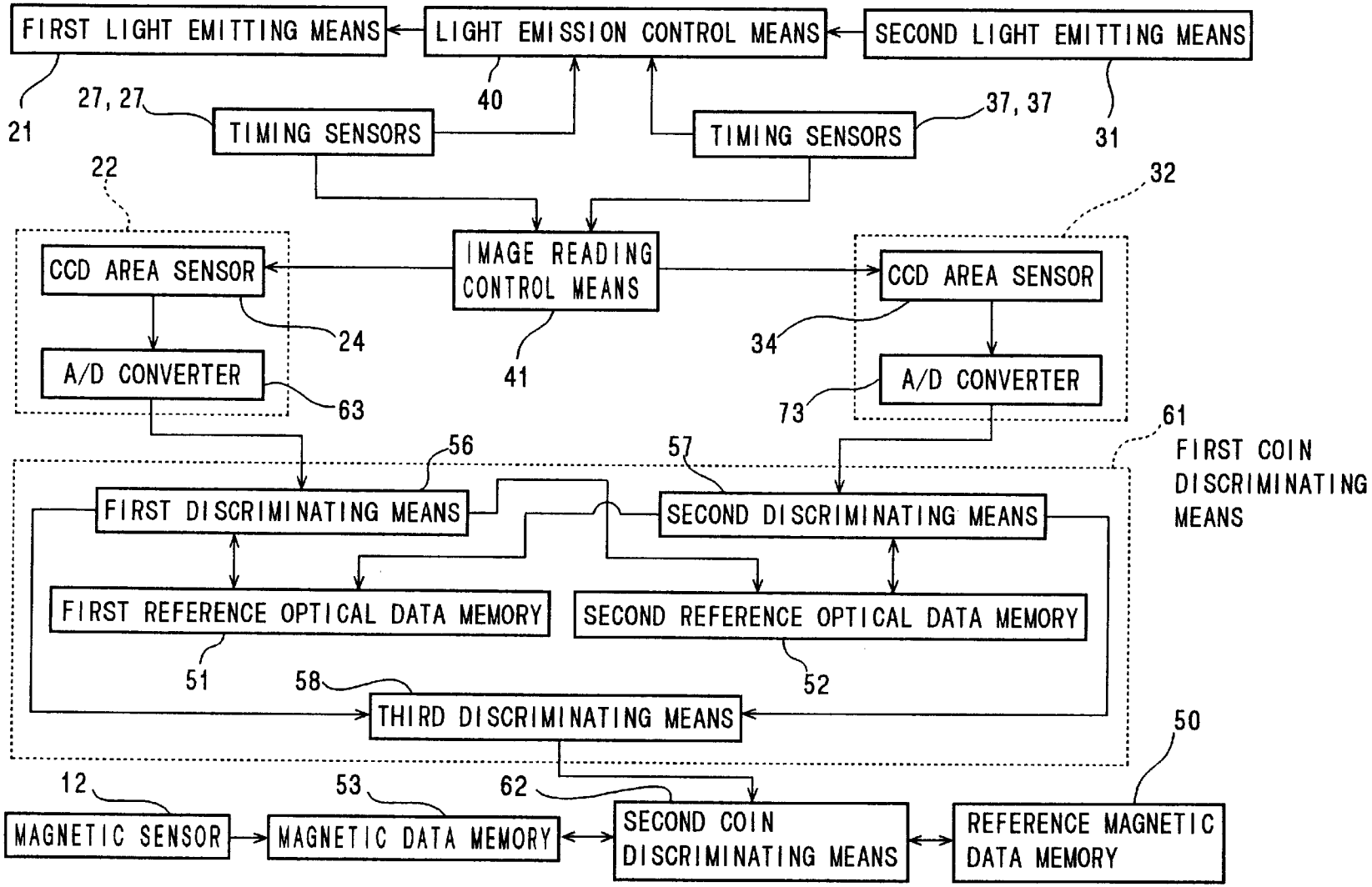
FIG. 6 is a block diagram of detection, control and discrimination systems of a coin discriminating apparatus which is another embodiment of the present invention.

FIG. 6 is a block diagram showing a detecting system, a control system, a memory system and a discriminating system of a coin discriminating apparatus which is another preferred embodiment of the present invention.

As shown in FIG. 6, similarly to the previous embodiment, the detection system of the coin discriminating apparatus includes timing sensors 27, 27, timing sensors 37, 37, a CCD area sensor 24 and a CCD area sensor 34.

As shown in FIG. 6, similarly to the previous embodiment, the control system of the coin discriminating apparatus includes light emission control means 40 and image reading control means 41.

As shown in FIG. 6, similarly to the previous embodiment, the memory system of the coin discriminating apparatus includes the reference magnetic data memory 50, a first optical data memory 51 for storing reference data relating to diameters of each denomination of coins, a second reference optical data memory 52 and a magnetic data memory 53 for storing magnetic data of a coin 1 produced by the magnetic sensor 12. However, in this embodiment, the second reference optical data memory 52 stores pattern data of both surfaces for each denomination mapped into an r-θ coordinate system.

As shown in FIG. 6, similarly to the previous embodiment, the discriminating system of the coin discriminating apparatus includes a first coin discriminating means 61 including a first discriminating means 56 for discriminating, based on image pattern data of the lower surface of a coin 1 produced by the first image data producing unit 22, whether or not the coin 1 is acceptable and the denomination of the coin 1 and whether the lower surface of the coin 1 is an obverse surface or a reverse surface of the coin 1, a second discriminating means 57 for discriminating, based on image pattern data of the upper surface of a coin 1 produced by the second image data producing unit 32, whether or not the coin 1 is acceptable and the denomination of the coin 1 and whether the upper surface of the coin 1 is an obverse surface or a reverse surface of the coin 1, a third discriminating means 58 for determining based on the results of discrimination made by the first discriminating means 56 and the second discriminating means 57 that the denomination of a coin 1 coincides with the denomination discriminated by the first discriminating means 56 and the second discriminating means 57 when the denomination of the coin 1 discriminated by the first discriminating means 56 coincides with that discriminated by the second discriminating means 57 and discriminating that a coin 1 is unacceptable when the denomination of the coin 1 discriminated by the first discriminating means 56 does not coincide with that discriminated by the second discriminating means 57, and a second coin discriminating means 62 for reading from the reference magnetic data memory 50 reference magnetic data corresponding to the denomination of the coin discriminated by the third discriminating means 58 of the first coin discriminating means 61 and corresponding to the denomination whose obverse surface reference pattern data or reverse surface reference pattern data were used by whichever of the first discriminating means 56 and the second discriminating means 57 discriminated based on the image pattern data of the surface of the coin 1 on the side of the transmitting coil 12*a* of the magnetic sensor 12 that the coin 1 was acceptable and what the denomination of the coin 1 was and comparing them with the magnetic data of the coin 1 produced by the magnetic sensor 12, thereby finally determining whether or not the coin 1 is acceptable and the denomination of the coin 1.

Figure 7:
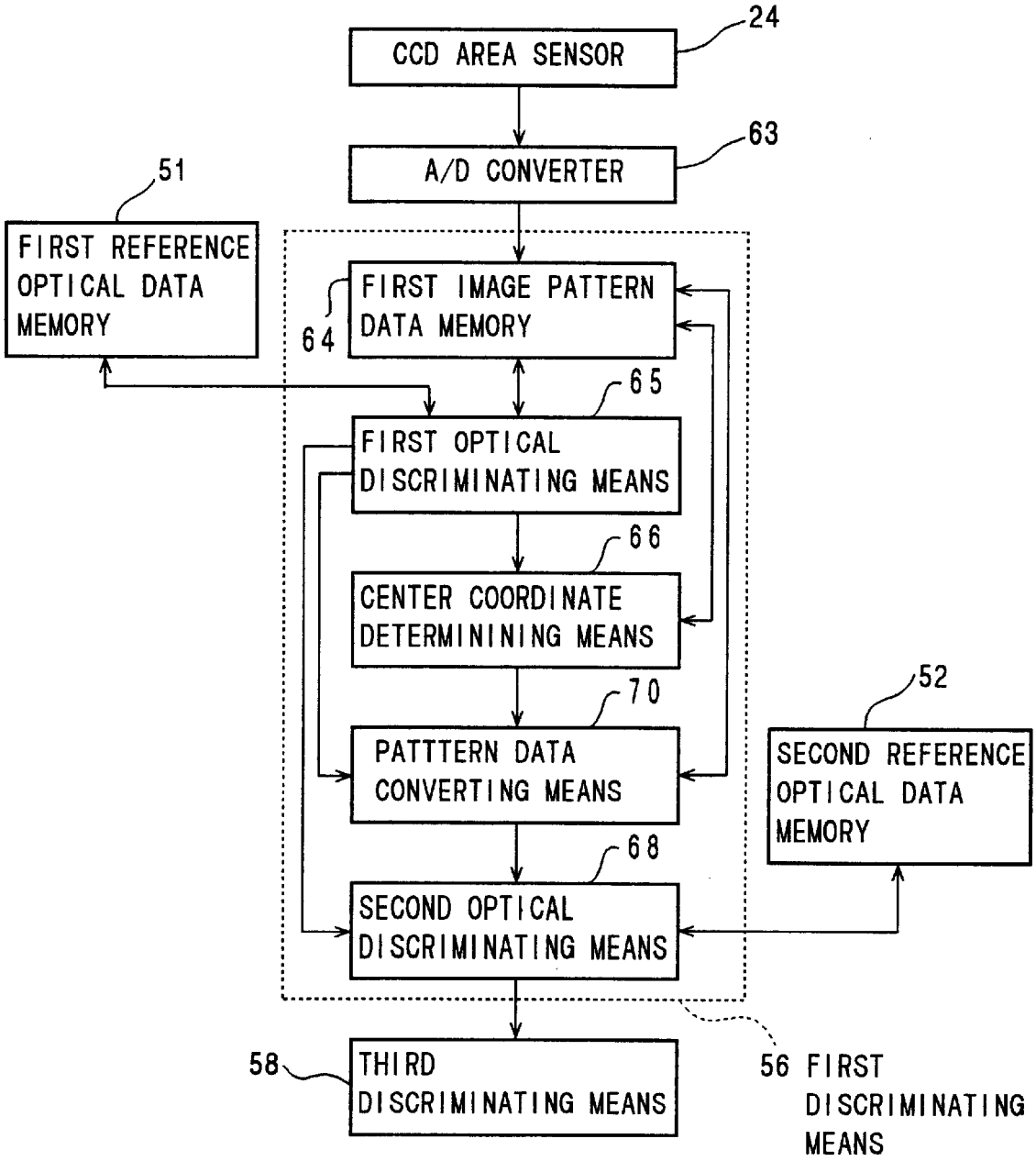
FIG. 7 is a block diagram of a first discriminating means.

FIG. 7 is a block diagram showing the first discriminating means 56.

As shown in FIG. 7, the first discriminating means 56 includes a first image pattern data memory 64 for mapping and storing the image pattern data of the lower surface of the coin 1 photoelectrically detected by the CCD area sensor 24 of the first image data producing unit 22 and digitized by the A/D converter 63 into an orthogonal coordinate system, i.e., an x-y coordinate system; a first optical discriminating means 65 for reading the reference data relating to the diameter of the coin of each denomination stored in the first reference optical data memory 51 and comparing them with the image pattern data of the coin 1 stored in the first image pattern data memory 64, thereby discriminating whether or not the coin is acceptable and the denomination of the coin 1; a center coordinate determining means 66 for obtaining the center coordinates of the image pattern data of the coin 1 mapped and stored in the first image pattern data memory 64; a pattern data converting means 70 for converting pattern data by transforming into the polar coordinate system, namely, the r-θ coordinate system, based on the center coordinate of the pattern data calculated by the center coordinate determining means 66; second optical discriminating means 68 for determining whether or not the coin 1 is acceptable and the denomination of the coin 1, by comparing the converted pattern data transformed into the r-θ coordinate system by the pattern data converting means 70 with the reference pattern data stored in the second reference optical data storing means 52.

Figure 8:
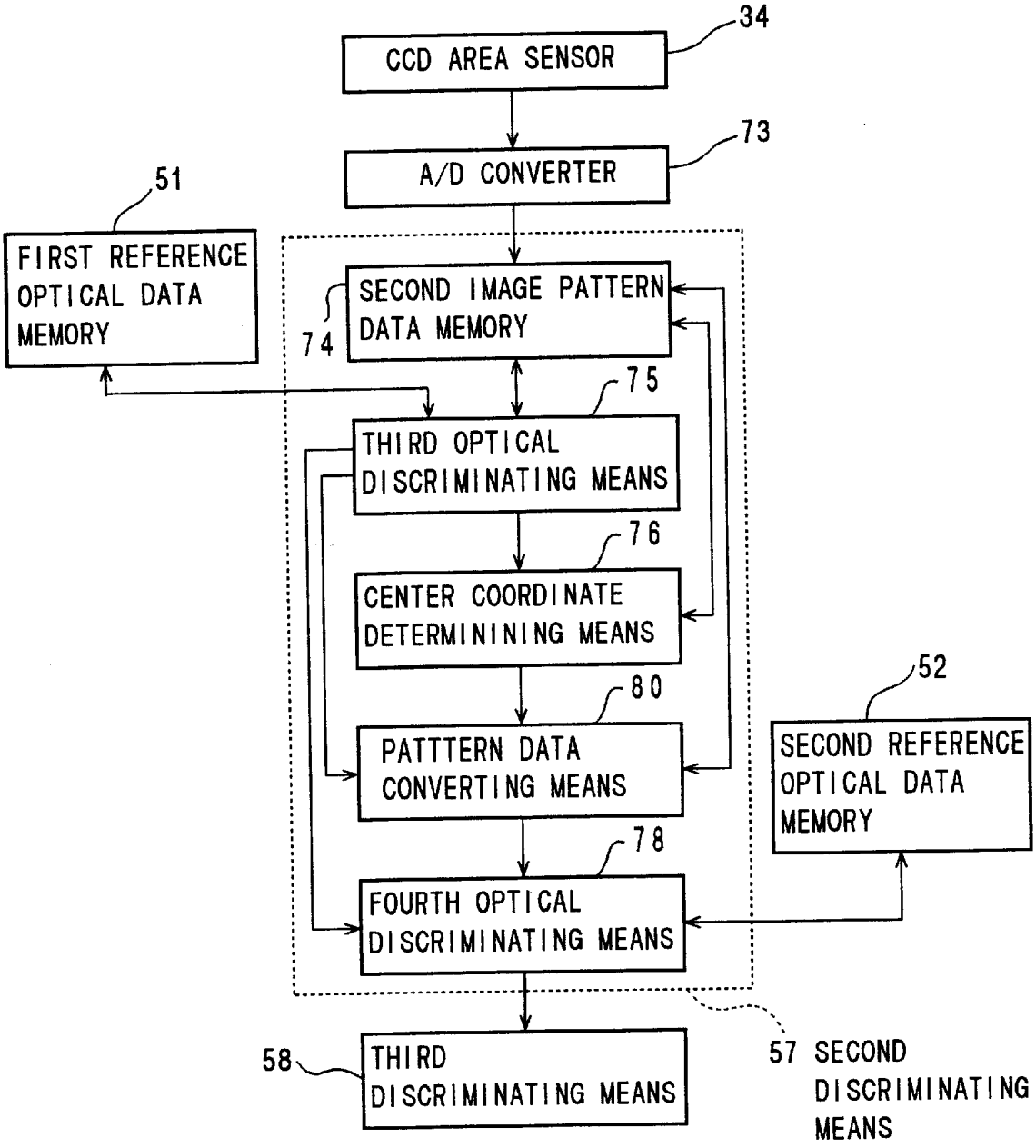
FIG. 8 is a block diagram of a second discriminating means.

FIG. 8 is a block diagram showing the second discriminating means 57.

As shown in FIG. 8, the second discriminating means 57 includes a second image pattern data memory 74 for mapping and storing the image pattern data of the upper surface of the coin 1 photoelectrically detected by the CCD area sensor 34 of the first image data producing unit 32 and digitized by the A/D converter 73 into an orthogonal coordinate system, i.e., an x-y coordinate system; third optical discriminating means 75 for reading the reference data relating to the diameter of the coin of each denomination stored in the first reference optical data memory 51 and comparing them with the image pattern data of the coin 1 stored in the second image pattern data memory 74, thereby discriminating whether or not the coin is acceptable and the denomination of the coin 1; center coordinate determining means 76 for obtaining the center coordinates of the image pattern data of the coin 1 mapped and stored in the second image pattern data memory 74; pattern data converting means 80 for converting pattern data by transforming into the polar coordinate- system, namely, the r-θ coordinate system, based on the center coordinate of the pattern data calculated by the center coordinate determining means 76; fourth optical discriminating means 78 for determining whether or not the coin 1 is acceptable and the denomination of the coin 1, by comparing the converted pattern data transformed into the r-θ coordinate system by the pattern data converting means 80 with the reference pattern data stored in the second reference optical data storing means 52.

Figure 9:
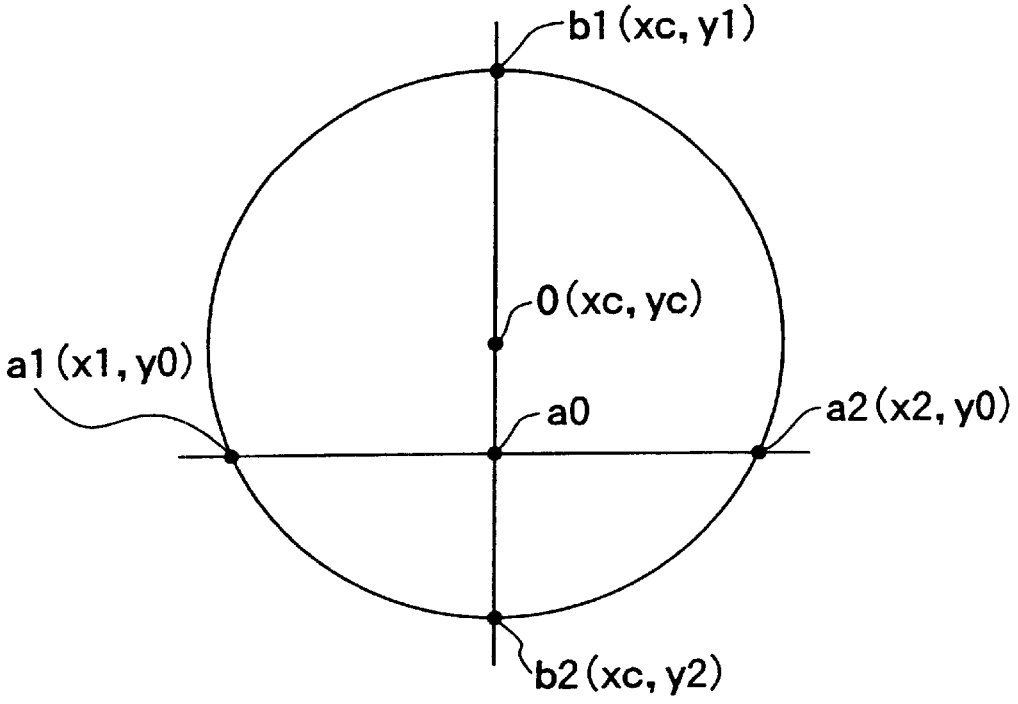
FIG. 9 is a schematic view showing a method for calculating the center coordinate of pattern data effected by a center coordinate calculating section.

FIG. 9 is a schematic view showing a method for determining the center coordinate of pattern data effected by the center coordinate determining means 66.

As shown in FIG. 9, the pattern data of the coin 1 produced by the CCD area sensor 24 are mapped in the x-y coordinate system and stored in the first image pattern data memory 64. The center coordinate determining means 66 determines x-coordinates x1 and x2 of boundary data a1 and a2 whose y-coordinate is y0 of the pattern data mapped and stored in the first image pattern data memory 64 and determines an x-coordinate xc=(x1+x2)/2 of a center data a0 between the boundary data a1 and a2. Then, the center coordinate determining means 66 draws an imaginary straight line from the data a0 perpendicular to a straight line extending through the boundary data a1 and a2 to determine y-coordinates y1 and y2 of boundary data b1 and b2 which correspond to the points of intersection of the imaginary straight line and the boundary of the pattern data and determines a y-coordinate yc=(y1+y2)/2 of center data O between the boundary data b1 and b2. The thus determined coordinates (xc, yc) of the data O corresponds to the center coordinate of the pattern data of the coin 1 mapped in the x-y coordinate system and the data O corresponds to the data center of the pattern data of the coin 1 mapped in the x-y coordinate system.

The method for determining the center coordinate of pattern data effected by the center coordinate determining means 76 is exactly the same as that effected by the center coordinate determining means 66.

Figure 10:
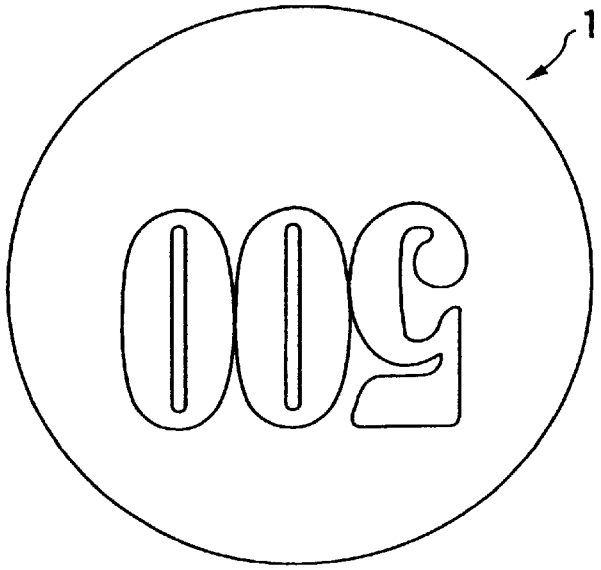
FIG. 10 is a view showing one example of pattern data of a coin produced by a CCD area sensor and mapped and stored in an image pattern data memory.
Figure 11:
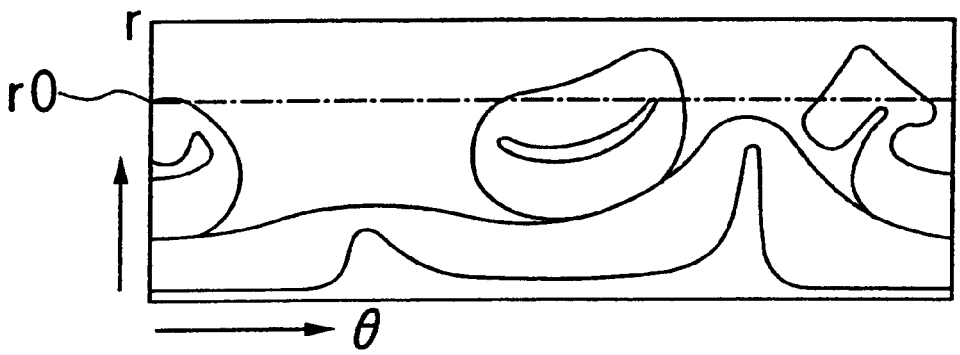
FIG. 11 is a view showing converted pattern data produced by transforming the pattern data shown in FIG. 10 into an r-θ coordinate system by pattern data conversion.

FIG. 10 is a view showing one example of pattern data of the coin 1 produced by the CCD area sensor 24 and mapped and stored in the first image pattern data memory 64 and FIG. 11 is a view showing converted pattern data produced by transforming the pattern data shown in FIG. 10 into the r-θ coordinate system by pattern data converting means 70 based upon the center coordinate (xc, yc) of the pattern data of the coin 1 determined by the center coordinate determining means 66. In FIG. 11, the ordinate represents the distance r from the data center O in the x-y coordinate system and the abscissa represents an angle θ about the data center O. An example of pattern data of the coin 1 produced by the CCD area sensor 34 and mapped and stored in the second image pattern data memory 74 is similar to the above and an example of converted pattern data produced by transforming the pattern data into the r-θ coordinate system by pattern data converting means 80.

The converted pattern data transformed into the r-θ coordinate system by the pattern data converting means 70 in this manner are input to the second optical discriminating means 68.

In response, the second optical discriminating means 68 selects, based on the result of discrimination made by the first optical discriminating means 65, the reference pattern data of the corresponding denomination from among the reference pattern data of coins mapped in the r-θ coordinate system and stored in the second reference optical data memory 52.

The processing of image pattern data of the coin 1 effected by the second discriminating means 57 is the same as that effected by the first discriminating means 56.

Figure 12:
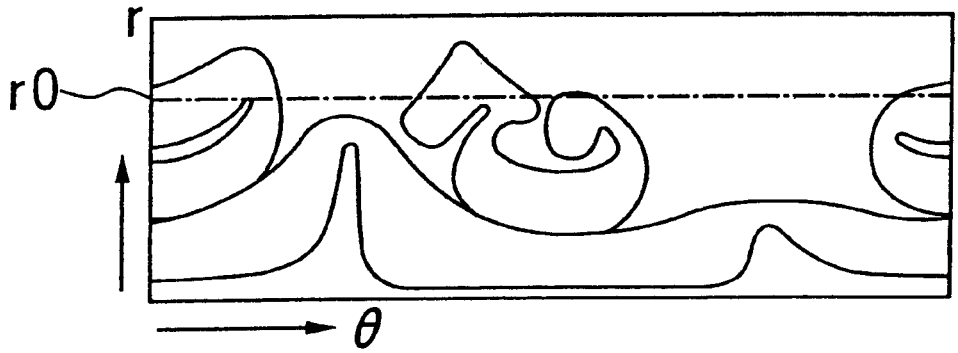
FIG. 12 a view showing reference pattern data of the coin shown in FIG. 10 mapped in an r-θ coordinate system.

FIG. 12 shows an example of the reference pattern data of the coin 1 shown in FIG. 10 and mapped in the r-θ coordinate system. This data corresponds to the converted pattern data shown in FIG. 11. Since the converted pattern data shown in FIG. 11 are obtained in the pattern data converting means 70 by transforming the pattern data in the x-y coordinate system into the r-θ coordinate system based on the center coordinates (xc, yc) of the pattern data of the coin 1 determined by the center coordinate determining means 66, the zero point of the ordinate, namely, the zero point of the r-axis coincides with the zero point of the reference pattern data shown in FIG. 12. However, since the orientation of the coin 1 to be discriminated is usually offset angularly (rotationally) from that of the coin 1 used for producing the reference pattern data, the pattern data in FIG. 11 and the reference pattern data in FIG. 12 at the same θ value are normally obtained from different portions of the coin 1. Accordingly, it is impossible to discriminate whether or not the coin 1 is acceptable and the denomination of the coin 1 by directly comparing the converted pattern data in FIG. 11 and the reference pattern data in FIG. 12 and, therefore, it is necessary to correct the converted pattern data prior to the comparison so that the zero point of the converted pattern data in the θ axis coincides with the zero point of the reference pattern data in the θ axis.

In view of the above, the second optical discriminating means 68 reads the pattern data values at a predetermined distance r0 from the data center of the converted pattern data shown in FIG. 11, namely, reads the pattern data values whose ordinate values are equal to a predetermined value r0 over 360 degrees, and reads the pattern data values at a predetermined distance r0 from the data center of the reference pattern data shown in FIG. 12, namely, reads the pattern data values whose ordinate values are equal to a predetermined value r0 over 360 degrees. Then, the second optical discriminating means 68 compares the two sets of pattern data values, thereby correcting the deviation of the converted pattern data in the θ axis caused by the angular offset of the coin 1.

Figure 13:
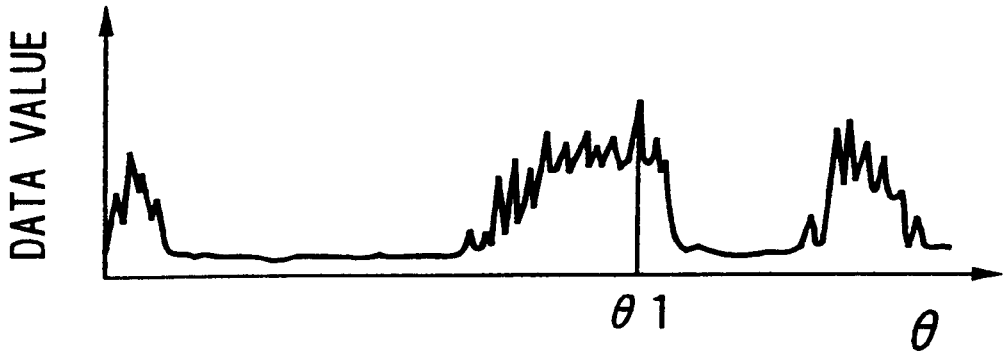
FIG. 13 is a graph showing pattern data values obtained by reading the converted pattern data shown in FIG. 11 over 360 degrees at a predetermined distance r0 from a data center.
Figure 14:
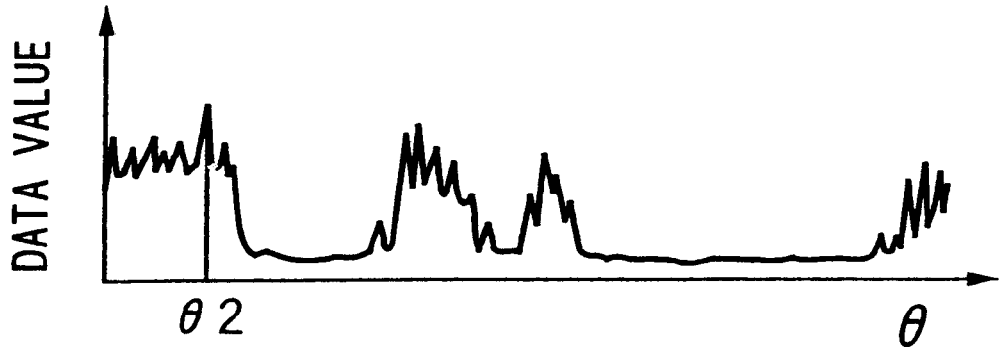
FIG. 14 is a graph showing pattern data values obtained by reading reference pattern data shown in FIG. 12 over 360 degrees at a predetermined distance r0 from the data center.

FIG. 13 is a graph showing pattern data values obtained by reading the converted pattern data shown in FIG. 11 over 360 degrees at a predetermined distance r0 from the data center and FIG. 14 is a graph showing pattern data values obtained by reading reference pattern data shown in FIG. 12 over 360 degrees at a predetermined distance r0 from the data center. In FIGS. 13 and 14, the ordinate represents data values and the abscissa represents the angle.

Coins 1 are fed through the coin passage 2, while being guided by the pair of guide rails 11, 11 and, therefore, the center of each coin 1 passes along a predetermined locus on the first transparent passage portion 9. On the contrary, the coin 1 is usually offset angularly from the coin used to produce the reference pattern data. Therefore, since the sets of pattern data at the same θ value in FIGS. 11 and 12 are normally obtained from different portions of the coin 1, it is necessary to correct the converted pattern data prior to the comparison so that the zero point of the converted pattern data in the θ axis coincides with the zero point of the reference pattern data in the θ axis.

Figure 15:
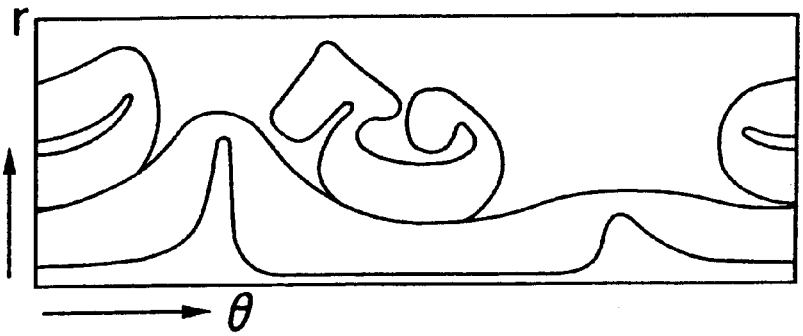
FIG. 15 is a view showing converted pattern data after remapping.

Accordingly, the second optical discriminating means 68 obtains θ values θ1 and θ2 at which the pattern data value shown in FIG. 13 and the pattern data value shown in FIG. 14 are maximum respectively and remaps the converted pattern data shown in FIG. 11 so that θ1 becomes equal to θ2. FIG. 15 shows the thus remapped converted pattern data.

The second optical discriminating means 68 compares the converted pattern data remapped in the above described manner and shown in FIG. 15 with the reference pattern data shown in FIG. 12 and discriminates whether or not the coin 1 is the coin of the denomination determined by the first optical discriminating means 65 or whether or not the coin 1 is acceptable, in accordance with the extent of how well the converted pattern data coincides with the reference pattern data.

The remapping processing of the converted pattern data effected by the fourth optical discriminating means 78 in the second discriminating means 57 is the same as that effected by the second optical discriminating means 68 in the first discriminating means 56.

The thus constituted coin discriminating apparatus according to this embodiment discriminates coins in the following manner.

The coin 1 is fed in the coin passage 2 along a pair of guide rails 11, 11 in the direction indicated by an arrow A. The coin 1 arrives at the first transparent passage portion 9 and when light emitted from the light emitting element 25 of each timing sensor 27, 27 is blocked by the coin 1 and the light receiving element 26 does not receive the light emitted from the light emitting element 25, timing signals are output to the light emission control means 40 and the image reading control means 41.

When the timing signals are input from the timing sensors 27, 27, the light emission control means 40 outputs a light emission signal to the first light emitting means 21 and causes the light emitting elements 20 to emit light toward the lower surface of the coin 1 located on the first transparent passage portion 9.

When the timing signals are input from the timing sensors 27, 27, the image reading control means 41 outputs a reading operation start signal to the CCD area sensor 24, thereby causing it to detect light reflected by the lower surface of the coin 1.

The image pattern data of the lower surface of the coin 1 produced by the CCD area sensor 24 and digitized by the A/D converter 63 are mapped and stored in the x-y coordinate system in the first image pattern data memory 64. FIG. 10 is a view showing one example of pattern data of the lower surface of the coin 1 mapped and stored in the first image pattern data memory 64.

When the image pattern data of the lower surface of the coin 1 are stored in the first image pattern data memory 64, the first optical discriminating means 65 accesses the first reference optical data memory 51. It reads the data stored in the first reference optical data memory 51 with regard to the diameter of the coin 1 and also reads the image pattern data of the coin 1 stored in the first image pattern data memory 64. By comparing those data, the first optical discriminating means 65 determines the denomination of the coin 1 and outputs the result of the discrimination to the second optical discriminating means 68.

On the other hand, the center coordinate determining means 66 determines the center coordinate (xc, yc) of the image pattern data of the coin 1 based on the image pattern data of the coin mapped in the x-y coordinate system and stored in the first image pattern data memory 64 and outputs the center coordinate to the pattern data converting means 70.

Based on the center coordinate (xc, yc) of the pattern data of the coin 1 input from the center coordinate determining means 66, the pattern data converting means 70 transforms the pattern data of the coin 1 mapped in the x-y coordinate system and stored in the first image pattern data memory 64 into an r-θ coordinate system and produces converted pattern data, thereby outputting them to the second optical discriminating means 68. FIG. 12 shows one example of the converted pattern data thus transformed into the r-θ coordinate system.

On the other hand, based upon the result of discrimination input from the first optical discriminating section 65, the second optical discriminating means 68 selects the reference pattern data of the reverse surface of the coin 1 corresponding to the denomination from among the reference pattern data mapped into the r-θ coordinate system and stored in the second reference optical data memory 52 and reads them. FIG. 13 shows one example of the reference pattern data output from the second reference optical data memory 52 to the second optical discriminating means 68.

Since the pattern data cannot be produced by the CCD area sensor 24 with the coin 1 in a predetermined angular orientation and the coin 1 is normally offset angularly from the coin 1 used for producing the reference pattern data, as is clear from FIGS. 11 and 12, the converted pattern data is normally offset along the abscissa, namely, the θ axis, with respect to the reference pattern data. Therefore, it is necessary to correct the deviation of the converted pattern data in the θ direction in order to discriminate the coin 1 by comparing the converted pattern data with the reference pattern data.

Accordingly, the second optical discriminating means 68 reads the pattern data values of the converted pattern data shown in FIG. 11 over 360 degrees whose ordinate values are equal to a predetermined value r0 and reads the pattern data values of the reference pattern data shown in FIG. 12 over 360 degrees whose ordinate values are equal to a predetermined value r0.

FIGS. 13 and 14 are graphs obtained by plotting the thus read converted pattern data values and reference pattern data values whose ordinate values are equal to a predetermined value r0. The second optical discriminating means 68 further calculates θ values at which the converted pattern data values and the reference pattern data values become maximum respectively. The thus obtained θ value is θ1 in FIG. 13 and the θ value is θ2 in FIG. 14.

When θ1 and θ2 are obtained in this manner, the second optical discriminating means 68 remaps the converted pattern data so that θ1 becomes equal to θ2. FIG. 15 shows an example of the converted pattern data thus remapped by the second optical discriminating means 68. Since the deviation of the converted pattern data in the θ direction caused by the angular offset of the coin 1 has been corrected by remapping the converted pattern data, it is possible for the second optical discriminating means 68 to discriminate whether the denomination of the coin 1 coincides with that determined by the first optical discriminating means 65 and whether or not the coin 1 is an unacceptable coin such as a counterfeit coin, a foreign coin or the like by pattern matching the converted pattern data with the reference pattern data.

However, since it is impossible to feed the coin 1 so that one surface thereof always faces upward, if the coin is fed in such a manner that the reverse surface faces upward, the remapped converted pattern data never coincides with the reference pattern data of the reverse surface of the coin 1 of the denomination determined by the first optical discriminating means 65. Therefore, when the remapped converted pattern data does not coincides with the reference pattern data of the reverse surface of the coin 1 of the denomination selected in accordance with the result of discrimination made by the first optical discriminating means 65, if the coin 1 is immediately discriminated as a counterfeit coin or a foreign coin, the coin discrimination accuracy becomes lowered.

Accordingly, in this embodiment, the converted pattern data is first compared with the reference pattern data of the reverse surface of the coin 1 of the denomination determined by the first optical discriminating means 65 and if they do not coincide, the converted pattern data is compared with the reference pattern data of the obverse surface of the coin 1 of the denomination in the same manner, thereby discriminating whether the denomination of the coin 1 coincides with that tentatively determined by the first optical discriminating means 65 and whether or not the coin 1 is an unacceptable coin such as a counterfeit coin, a foreign coin or the like.

The result of discrimination made by the second optical discriminating means 68 in the first discriminating means 56 is output to the third discriminating means 58 as a first discrimination signal.

The coin 1 is further fed to the second transparent passage portion 10 in the coin passage 2 and when light emitted from the light emitting element 35 of each timing sensor 37, 37 is blocked by the coin 1 and the light receiving element 36 does not receive the light emitted from the light emitting element 35, timing signals are output from the timing sensors 37, 37 to the light emission control means 40 and the image reading control means 41.

When the timing signals are input from the timing sensors 37, 37, the light emission control means 40 outputs a light emission signal to the second light emitting means 31 and causes the light emitting elements 30 to emit light toward the upper surface of the coin 1 located on the second transparent passage portion 10.

When the image reading control means 41 receives the timing signals from the timing sensors 37, 37, it causes the CCD area sensor 34 of the second image data producing unit 32 to start detecting light emitted from the light emitting elements 30 and reflected by the upper surface of the coin 1.

Since the light emitting means 31 is disposed so as to be able to illuminate the coin 1 which advances on the second transparent passage portion 10 at a shallow angle, the light is reflected according to the raised and depressed pattern of the upper surface of the coin 1. The light reflected from the surface of the coin 1 is directed toward the CCD area sensor 34 by the lens system 33 and photoelectrically detected by the CCD area sensor 34, whereby the image pattern data of the surface of the coin 1 are produced by the CCD area sensor 34. The image pattern data of the surface of the coin 1 produced by the CCD area sensor 34 are digitized by the A/D converter 73. The digitized image pattern data are mapped and stored in the orthogonal coordinate system, namely, the x-y coordinate system, in the second image pattern data memory 74 of the second discriminating means 57.

When the image pattern data of the upper surface of the coin 1 are stored in the second image pattern data memory 74, the third optical discriminating means 75 of the second discriminating means 57 accesses the first reference data memory 51. It reads the data stored in the first reference data memory 51 with regard to the diameter of the coin 1 and also the image pattern data of the coin 1 stored in the second image pattern data memory 74. By comparing these data, the third optical discriminating means 75 of the second discriminating means 57 determines whether or not the coin 1 is acceptable and the denomination of the coin 1.

On the other hand, the center coordinate determining means 76 determines the center coordinate (xc, yc) of the image pattern data mapped in the x-y coordinate system and stored in the second image pattern data memory 74 and outputs the center coordinate (xc, yc) to the pattern data converting means 80.

Based on the center coordinates (xc, yc) of the pattern data of the coin 1 input from the center coordinate determining means 76, the pattern data converting means 80 transforms the pattern data of the coin 1 mapped in the x-y coordinate system and stored in the second image pattern data memory 74 into an r-θ coordinate system.

On the other hand, based upon the result of discrimination made by the third optical discriminating means 75, the fourth optical discriminating means 78 of the second discriminating means 57 selects the reference pattern data of the reverse surface of the coin 1 corresponding to the denomination from among the reference pattern data mapped into the r-θ coordinate system and stored in the second reference optical data memory 52 and reads them.

In the same manner as the second optical discriminating means 68 of the first discriminating means 56, the fourth optical discriminating means 78 of the second discriminating means 57 corrects the deviation of the converted pattern data in the θ direction and remaps the converted pattern data. By pattern matching the thus corrected converted pattern data with the reference pattern data, the fourth optical discriminating means 78 of the second discriminating means 57 then discriminates whether or not the coin 1 is the coin of the denomination discriminated by the third optical discriminating means 75 and whether or not the coin 1 is an unacceptable coin such as a counterfeit coin, a foreign coin or the like. The result of discrimination made by the fourth optical discriminating means 78 of the second discriminating means 57 is output to the third discriminating means 58 as a second discrimination signal.

The third discriminating means 58 first determines whether or not the coin 1 has been discriminated to be acceptable based on the first discrimination signal input from the second optical discriminating means 68 of the first discriminating means 56 and the second discrimination signal input from the fourth optical discriminating means 78 of the second discriminating means 57.

When the coin 1 has been discriminated to be unacceptable by at least one of the second optical discriminating means 68 of the first discriminating means 56 and the fourth optical discriminating means 78 of the second discriminating means 57, the third discriminating means 58 determines that the coin 1 is unacceptable.

Even if both the second optical discriminating means 68 of the first discriminating means 56 and the fourth optical discriminating means 78 of the second discriminating means 57 discriminated the coin 1 to be acceptable, when the denomination of the coin 1 determined by the second optical discriminating means 68 of the first discriminating means 56 and the denomination of the coin 1 determined by the fourth optical discriminating means 78 of the second discriminating means 57 do not coincide, the third discriminating means 58 determines that the coin 1 is unacceptable.

To the contrary, when both the second optical discriminating means 68 of the first discriminating means 56 and the fourth optical discriminating means 78 of the second discriminating means 57 discriminated the coin 1 to be acceptable and when the denomination of the coin 1 determined by the second optical discriminating means 68 of the first discriminating means 56 and the denomination of the coin 1 determined by the fourth optical discriminating means 78 of the second discriminating means 57 coincide, the third discriminating means 58 judges, based on the first discrimination signal input from the second optical discriminating means 68 of the first discriminating means 56 and the second discrimination signal input from the fourth optical discriminating means 78 of the second discriminating means 57, whether the second optical discriminating means 68 of the first discriminating means 56 determined the coin 1 to be acceptable based on the obverse surface reference pattern data or the reverse surface reference pattern data of a coin of the denomination, and whether the fourth optical discriminating means 78 of the second discriminating means 57 determined the coin 1 to be acceptable based on the obverse surface reference pattern data or the reverse surface reference pattern data of a coin of the denomination.

As a result, when the second optical discriminating means 68 of the first discriminating means 56 and the fourth optical discriminating means 78 of the second discriminating means 57 determined the coin 1 to be acceptable based on the reference pattern data of the same surface of a coin of the denomination, the third discriminating means 58 discriminates the coin 1 to be unacceptable.

To the contrary, when the second optical discriminating means 68 of the first discriminating means 56 and the fourth optical discriminating means 78 of the second discriminating means 57 determined the coin 1 to be acceptable based on the reference pattern data of different surfaces of a coin 1 of the denomination, the third discriminating means 58 outputs the denomination determined by the second optical discriminating means 68 of the first discriminating means 56 and the fourth optical discriminating means 78 of the second discriminating means 57 to the second coin discriminating means 62 as a denomination discrimination signal and judges, in accordance with the first discrimination signal input from the second optical discriminating means 68 of the first discriminating means 56 or the second discrimination signal input from the fourth optical discriminating means 78 of the second discriminating means 57, which surface reference pattern data of a coin of the denomination was used by whichever of the first discriminating means 56 and the second discriminating means 57 discriminated the coin 1 to be acceptable based on image pattern data of the surface of the coin on the side of the transmitting coil 12*a* of the magnetic sensor 12, thereby outputting a surface determination signal to the second coin discriminating means 62.

Based on the denomination discrimination signal and the surface determination signal input from the third discriminating means 58, the second coin discriminating means 62 reads out the reference magnetic data of the obverse surface or the reverse surface of a coin of the denomination discriminated by the third discriminating means 58 from the reference magnetic data memory 50, reads out the magnetic data of the coin 1 produced by detecting magnetic properties of the coin 1 by the magnetic sensor 12 and stored in the magnetic data memory 53, and compares the two sets of data.

As a result, when the second coin discriminating means 62 judges with reference to the predetermined threshold value that the reference magnetic data of the surface of a coin of the denomination and the magnetic data of the coin 1 do not coincide, it finally discriminates that the coin is unacceptable.

To the contrary, when the second coin discriminating means 62 judges with reference to the predetermined threshold value that the reference magnetic data of the surface of a coin of the denomination and the magnetic data of the coin 1 coincide, it finally discriminates that the denomination of the coin 1 coincides with that discriminated by the third discriminating means 58.

Thus, coins discriminated to be unacceptable are sorted and collected separately from coins discriminated to be acceptable.

According to the above described embodiment, the first image data producing unit 22 produces the image pattern data of one surface of a coin 1 and the second image data producing unit 32 produces the image pattern data of the other surface of the coin 1. The first discriminating means 56 of the first coin discriminating means 61 compares the image pattern data of the one surface of the coin 1 and the reference optical data of the obverse and reverse surfaces of coins of each denomination and determines whether or not the coin 1 is acceptable and the denomination of the coin 1 when the coin 1 is acceptable, and the second discriminating means 57 of the first coin discriminating means 61 compares the image pattern data of the other surface of the coin 1 and the reference optical data of the obverse and reverse surfaces of coins of each denomination and determines whether or not the coin 1 is acceptable and the denomination of the coin 1 when the coin 1 is acceptable. When the denomination of the coin 1 determined by the first discriminating means 56 and that of the coin 1 determined by the second discriminating means 57 coincide, the third discriminating means 58 outputs the denomination of the coin 1 to the second coin discriminating means 62 as a denomination determination signal, and judges, in accordance with the first discrimination signal input from the second optical discriminating means 68 or the second discrimination signal input from the fourth optical discriminating means 78, which surface reference ratio data of a coin of the denomination was used by the second discriminating means 57 the one of the first discriminating means 56 and the second discriminating means 57 that determined the coin 1 based on the image pattern data of the surface of a coin 1 on the side of the transmitting coil 12*a* of the magnetic sensor 12 to discriminate the coin 1 to be acceptable, thereby outputting a surface determination signal to the second coin discriminating means 62. Based on the denomination discrimination signal and the surface determination signal input from the third discriminating means 58, the second coin discriminating means 62 reads out the reference ratio data of the obverse surface or the reverse surface of a coin of the denomination discriminated by the third discriminating means 58 from the reference magnetic data memory 50, reads out the magnetic data of the coin 1 produced by detecting magnetic properties of the coin 1 by the magnetic sensor 12 and stored in the magnetic data memory 53, and compares the two sets of data, thereby finally discriminating whether or not the coin 1 is acceptable and the denomination of the coin 1 when the coin 1 is acceptable. Therefore, since the first coin discriminating means 61 discriminates whether or not the coin 1 is acceptable and the denomination of the coin 1 based on the image pattern data of both surfaces of the coin 1 and the second coin discriminating means 62 reads out, based on the denomination of the coin 1 determined by the third discriminating means 58, the reference ratio data of a coin from the reference magnetic data memory 50, the second coin discriminating means 62 can discriminate whether or not the coin 1 is acceptable and the denomination of the coin 1 based on the reference magnetic data of a proper denomination, thereby improving the discrimination accuracy of coins. Further, based on the image pattern data of the surface of the coin 1 on the side of the transmitting coil 12*a* of the magnetic sensor 12, the second coin discriminating means 62 reads out from the reference magnetic data memory 50 the reference magnetic data corresponding to the surface of a coin of the reference optical data employed by the second discriminating means 57 which has determined the denomination of the coin 1 and discriminates whether or not the coin 1 is acceptable and the denomination of the coin 1. Therefore, even when image pattern data of a counterfeit coin coincides with image pattern data of a coin of a certain denomination and the magnetic properties of the counterfeit coin are similar to those of the denomination of the coin, it is possible to discriminate the counterfeit coin with high accuracy.

Moreover, according to the previous embodiment, the denomination of the coin 1 and whether or not the coin 1 is acceptable are discriminated based on only the ratio of the "0" data in the binary image pattern data groups corresponding to each annular area of the coin 1. Therefore, even though the coin 1 is a counterfeit coin or a foreign coin and an unacceptable coin, the ratio data which corresponds to the ratio of the "0" data in the binary image pattern data groups corresponding to each annular area of the coin 1 may perchance to coincide with the reference ratio data of the coin of the denomination determined by the second optical discriminating means 68 and the fourth optical discriminating means 78. However, according to this embodiment, since the coin 1 is discriminated by detecting the pattern of the entire surface of the coin 1 to produce the pattern data and comparing the thus produced pattern data with the reference pattern data of coin of the denomination determined by the second optical discriminating means 68 and the fourth optical discriminating means 78, the discriminating accuracy of the coin 1 can be improved.

Further, according to the above described embodiment, the deviation of the converted pattern data in the θ direction caused by the angular offset of a coin 1 can be corrected only by obtaining the values θ1 and θ2 at which the respective data values of the converted pattern data and the reference pattern data become maximum and remapping the converted pattern data so that θ1 becomes equal to θ2. It is therefore possible to shorten the time for calculation, whereby coins 1 can be discriminated at high speed.

Figure 16:
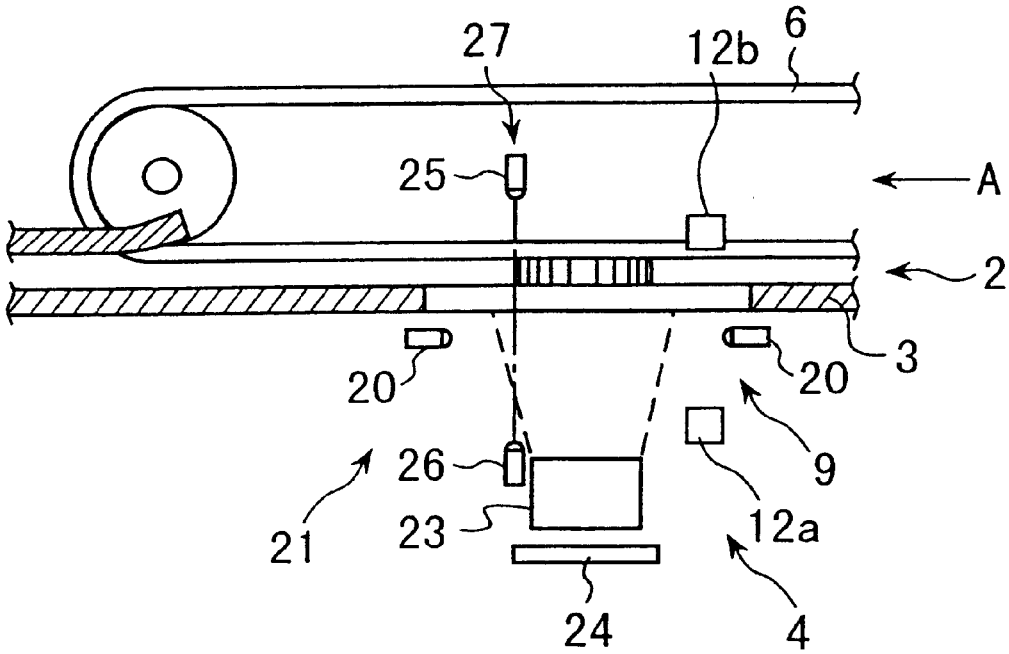
FIG. 16 is a schematic front view of a coin discriminating apparatus which is a further embodiment of the present invention.

FIG. 16 is a perspective front view showing a coin discriminating apparatus which is a further preferred embodiment of the present invention.

As shown in FIG. 16, in the coin discriminating apparatus according to this embodiment, only a first pattern data detection unit 4 is provided and neither a second pattern data detection unit 5 nor a second transparent passage portion 10 is provided.

As shown in FIG. 16, this embodiment is provided with a transmission-type magnetic sensor 12 whose transmitting coin 12*a* is disposed below the coin passage 2 and receiving coil 12*b* is disposed above the coin passage 2.

Figure 17:
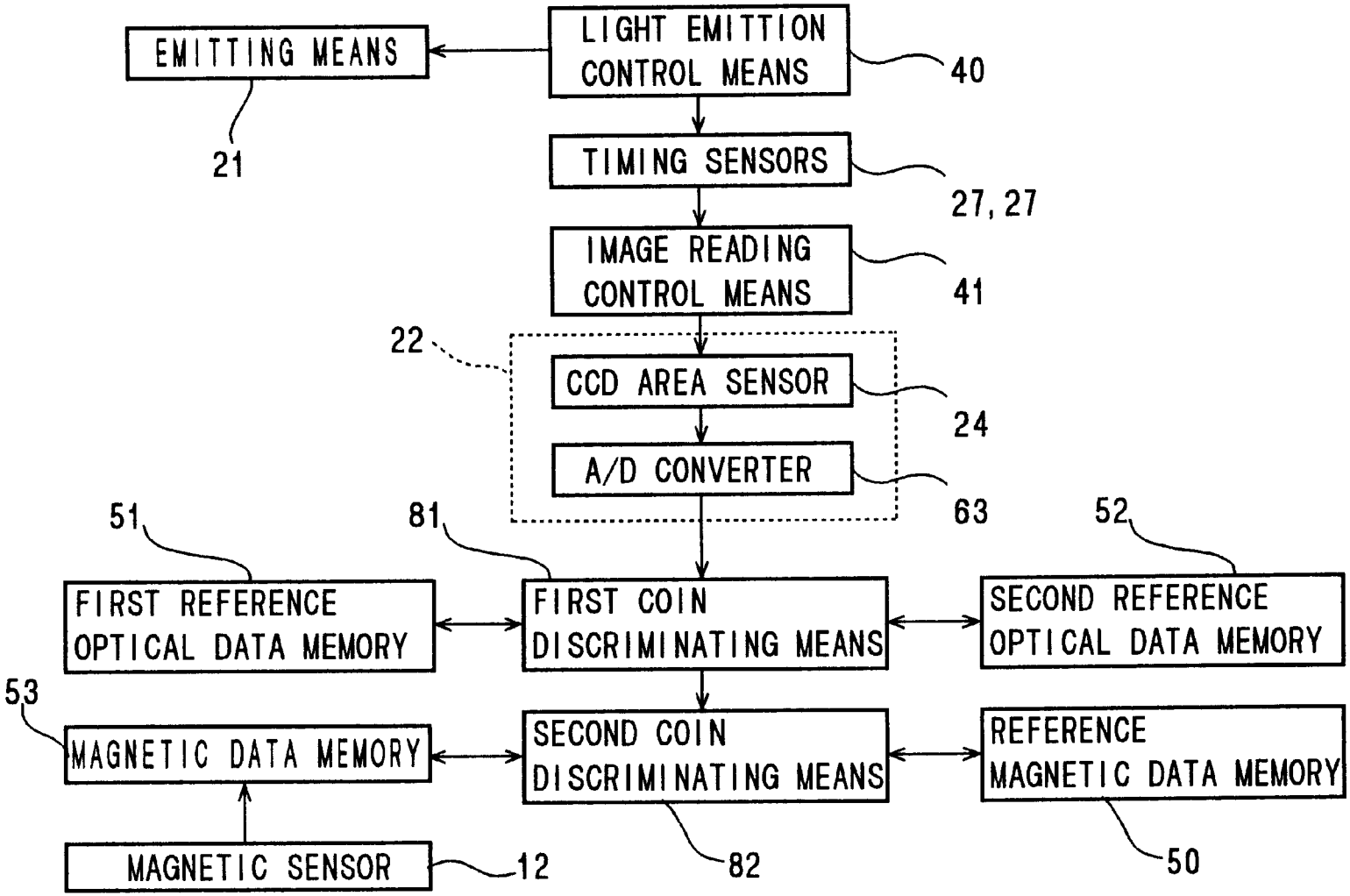
FIG. 17 is a block diagram of detection, control, memory and discrimination systems of a coin discriminating apparatus which is a further embodiment of the present invention.

FIG. 17 is a block diagram of a detection system, a control system, a memory system and a discrimination system of a coin discriminating apparatus which is a further preferred embodiment of the present invention.

As shown in FIG. 17, the detection system of the coin discriminating apparatus includes two sets of timing sensors 27, 27 for detecting a coin 1 fed to the first transparent passage portion 9, the magnetic sensor 12 comprising the transmitting coil 12*a* and receiving coil 12*b* pair for detecting magnetic properties of coins 1 and producing magnetic data of coins 1 and a CCD area sensor 24 for receiving light reflected by the lower surfaces of coins 1 and producing image pattern data of the lower surfaces of coins 1. In FIG. 17, 63 designates an A/D converter for digitizing analog image pattern data of coins 1 produced by the CCD area sensor 24.

As shown in FIG. 17, the control system of the coin discriminating apparatus includes a light emission control means 40 which outputs a light emission signal to the first light emitting means 21 when the timing signal from the timing sensors 27, 27 is received and causes it to emit light and illuminate the coin 1 located on the upper surface of the first transparent passage portion 9 and image reading control means 41 for permitting the CCD area sensor 24 of the first image data producing unit 22 to start detecting the light reflected from the surface of the coin 1 when the timing signal from the timing sensors 27, 27 is received.

As shown in FIG. 17, the memory system of the coin discriminating apparatus includes a reference magnetic data memory 50 for storing reference magnetic data indicating magnetic properties of the observe and reverse surfaces of each denomination of coins to be detected, a first reference optical data memory 51 for storing reference data relating to diameters of each denomination of coins, and a second reference optical data memory 52 for storing reference pattern data of obverse surfaces and reverse surfaces of coins of each denomination, and a magnetic data memory 53 for storing magnetic data of coins 1 produced by the magnetic sensor 12.

As shown in FIG. 17, the discriminating system of the coin discriminating apparatus includes first coin discriminating means 81 for discriminating, based on image pattern data of the lower surface of a coin 1 produced by the first image data producing unit 22, whether or not the coin 1 is acceptable and the denomination of the coin 1 and whether the lower surface of the coin 1 is an obverse surface or a reverse surface of the coin 1, and second coin discriminating means 82 for reading from the reference magnetic data memory 50 reference magnetic data corresponding to the denomination of the coin 1 discriminated by the first coin discriminating means 81 and corresponding to the surface determined depending on whether the reference pattern data used by the first coin discriminating means 81 to discriminate that the coin 1 is acceptable and the denomination of the coin 1 are reference pattern data of an obverse surface or those of a reverse surface of the coin 1 and compares them with the magnetic data of the coin 1 produced by the magnetic sensor 12, thereby finally discriminating whether or not the coin 1 is acceptable and the denomination of the coin 1.

Figure 18:
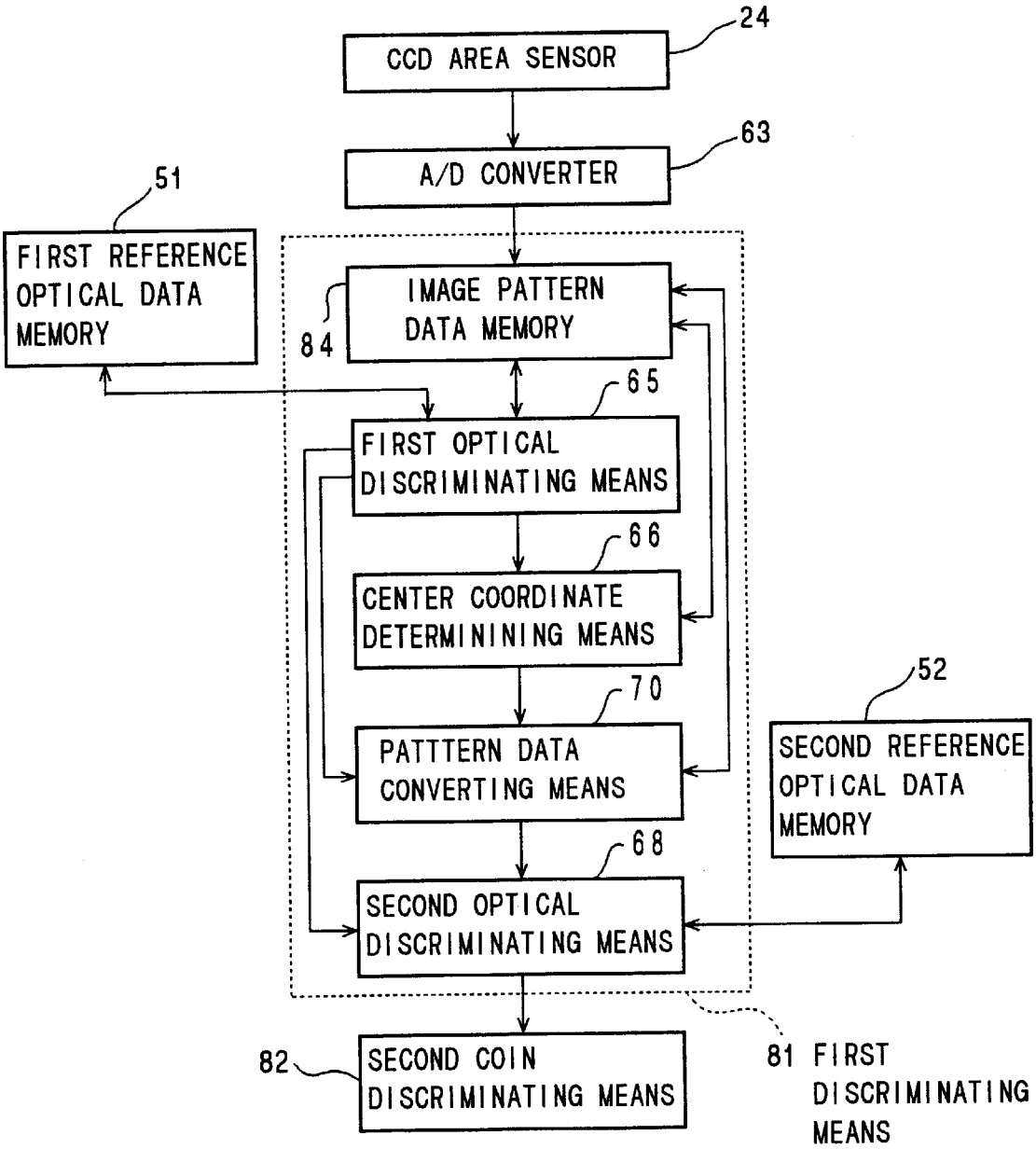
FIG. 18 is a block diagram of a first coin discriminating means.

FIG. 18 is a block diagram showing the first coin discriminating means 81.

As shown in FIG. 18, similarly to the embodiment shown in FIGS. 6 to 15, the first coin discriminating means 81 includes an image pattern data memory 84 for mapping and storing the image pattern data of the lower surface of the coin 1 photoelectrically detected by the CCD area sensor 24 of the first image data producing unit 22 and digitized by the A/D converter 63 into an orthogonal coordinate system, i.e., an x-y coordinate system; first optical discriminating means 65 for reading the reference data relating to the diameter of the coin of each denomination stored in the first reference optical data memory 51 and comparing them with the image pattern data of the coin 1 stored in the image pattern data memory 84, thereby discriminating whether or not the coin is acceptable and the denomination of the coin 1; center coordinate determining means 66 for obtaining the center coordinates of the image pattern data of the coin 1 mapped and stored in the image pattern data memory 84; pattern data converting means 70 for converting pattern data by transforming into the polar coordinate system, namely, the r-θ coordinate system, based on the center coordinate of the pattern data calculated by the center coordinate determining means 66; second optical discriminating means 68 for comparing the converted pattern data transformed into the r-θ coordinate system by the pattern data converting means 70 with the reference pattern data stored in the second reference optical data storing means 52 and determining whether or not the coin 1 is acceptable and the denomination of the coin 1, thereby outputting a discrimination signal to the second coin discriminating means 82.

The thus constituted coin discriminating apparatus according to this embodiment discriminates coins in the following manner.

The coin 1 is fed in the coin passage 2 along a pair of guide rails 11, 11 in the direction indicated by an arrow A. The coin 1 arrives at the first transparent passage portion 9 and when light emitted from the light emitting element 25 of each timing sensor 27, 27 is blocked by the coin 1 and the light receiving element 26 does not receive the light emitted from the light emitting element 25, timing signals are output to the light emission control means 40 and the image reading control means 41.

When the timing signals are input from the timing sensors 27, 27, the light emission control means 40 outputs a light emission signal to the first light emitting means 21 and causes the light emitting elements 20 to emit light toward the lower surface of the coin 1 located on the first transparent passage portion 9.

When the timing signals are input from the timing sensors 27, 27, the image reading control means 41 outputs a reading operation start signal to the CCD area sensor 24, thereby causing it to detect light reflected by the lower surface of the coin 1.

The image pattern data of the lower surface of the coin 1 produced by the CCD area sensor 24 and digitized by the A/D converter 63 are mapped and stored in the x-y coordinate system in the image pattern data memory 84 similarly to the embodiment shown in FIGS. 6 to 15.

When the image pattern data of the lower surface of the coin 1 are stored in the image pattern data memory 84, the first optical discriminating means 65 accesses the first reference optical data memory 51. It reads the data stored in the first reference optical data memory 51 with regard to the diameter of the coin 1 and also reads the image pattern data of the coin 1 stored in the image pattern data. memory 84. By comparing those data, the first optical discriminating means 65 determines whether or not the coin 1 is acceptable and the denomination of the coin 1 when the coin 1 is acceptable.

On the other hand, the center coordinate determining means 66 determines the center coordinate (xc, yc) of the image pattern data of the coin 1 based on the image pattern data of the coin mapped in the x-y coordinate system and stored in the image pattern data memory 84 and outputs the center coordinate to the pattern data converting means 70.

Based on the center coordinate (xc, yc) of the pattern data of the coin 1 input from the center coordinate determining means 66, similarly to the embodiment shown in FIGS. 6 to 15, the pattern data converting means 70 transforms the pattern data of the coin 1 mapped in the x-y coordinate system and stored in the image pattern data memory 84 into an r-θ coordinate system and produces converted pattern data, thereby outputting them to the second optical discriminating means 68.

On the other hand, based upon the result of discrimination input from the first optical discriminating section 65, the second optical discriminating means 68 selects the reference pattern data of the reverse surface of the coin 1 corresponding to the denomination from among the reference pattern data mapped into the r-θ coordinate system and stored in the second reference optical data memory 52 and reads them.

The second optical discriminating means 68 corrects the converted pattern data of the coin 1 similarly to the embodiment shown in FIGS. 6 to 15 and compares them with the reference pattern data of the reverse surface of the coin of the denomination read out from the second reference optical reference data memory 52 based on the result of discrimination input from the first optical discriminating means 65. The second optical discriminating means 68 further reads the reference pattern data of the obverse surface of the coin of the denomination from the second reference optical reference data memory 52 based on the result of discrimination input from the first optical discriminating means 65 and compares them with the corrected converted pattern data of the coin 1. Based on the comparison, the second optical discriminating means 68 determines whether or not the coin 1 is acceptable and the denomination of the coin 1.

As a result, when the result of discrimination made by the second optical discriminating means 68 differs from that made by the first optical discriminating means 65, the second optical discriminating means 68 discriminates that the coin 1 is unacceptable. On the other hand, when the denomination of the coin 1 determined by the first optical discriminating means 65 and the denomination of the coin 1 determined by the second optical discriminating means 68 coincide, the second optical discriminating means 68 outputs a discrimination signal to the second coin discriminating means 82 and also outputs to the second coin discriminating means 82 a surface discrimination signal indicating which reference pattern data, those of the obverse surface or those of the reverse surface of the denomination, it used to determine the denomination of the coin 1 based on.

The second coin discriminating means 82 determines the denomination of the reference magnetic data to be read from the reference magnetic data memory 50 based on the discrimination signal input from the second optical discriminating means 68 of the first coin discriminating means 81 and determines whether the reference magnetic data of the obverse surface of a coin of the denomination or the reference magnetic data of the reverse surface of a coin of the denomination should be read.

The second coin discriminating means 82 reads the thus selected reference magnetic data of the obverse surface or the reverse surface of a coin of the denomination from the reference magnetic data memory 50, reads the magnetic data of the coin 1 from the magnetic data memory 53, and compares the two sets of data.

When the second coin discriminating means 82 judges with reference to the predetermined threshold value that the reference magnetic data of the surface of a coin of the denomination and the magnetic data of the coin 1 do not coincide, it finally discriminates that the coin is unacceptable.

To the contrary, when the second coin discriminating means 82 judges with reference to the predetermined threshold value that the reference magnetic data of the surface of a coin of the denomination and the magnetic data of the coin 1 coincide, it finally discriminates that the denomination of the coin 1 coincides with that discriminated by the second optical discriminating means 68 of the first coin discriminating means 81.

According to the above described embodiment, since whether or not the coin 1 is acceptable and the denomination of the coin 1 are discriminated using a single pattern data detection unit 4, it is possible to simplify the structure of the coin discriminating apparatus and make it compact.

Nevertheless, according to this embodiment, since the reference magnetic data of the obverse surface or the reverse surface of a coin corresponding to the reference pattern data used by the first coin discriminating means 81 to discriminate whether or not the coin 1 is acceptable and the denomination of the coin 1 are compared with the magnetic data of the coin 1, whereby whether or not the coin 1 is acceptable and the denomination of the coin 1 are finally discriminated, even when image pattern data of a counterfeit coin coincides with image pattern data of a coin of a certain denomination and the magnetic properties of the counterfeit coin are similar to those of the denomination of the coin, it is possible to discriminate the counterfeit coin with high accuracy.

The present invention has thus been shown and described with reference to specific embodiments. However, it should be noted that the present invention is in no way limited to the details of the described arrangements but changes and modifications may be made without departing from the scope of the appended claims.

For example, in the embodiments shown in FIGS. 1 to 15, although the second pattern data detection unit 5 is provided downstream of the first pattern data detection unit 4 so that pattern data of the lower surface of a coin 1 are produced by the first pattern data detection unit 4 and that pattern data of the upper surface of a coin 1 are produced by the second pattern data detection unit 5, the first pattern data detection unit 4 may be provided downstream of the second pattern data detection unit 5.

Further, in the embodiments shown in FIGS. 1 to 15, although the second pattern data detection unit 5 is provided downstream of the first pattern data detection unit 4, the first pattern data detection unit 4 and the second pattern data detection unit 5 may be provided on the opposite sides of the coin passage 2 so as to face each other. In such a case, one of the two pairs of the timing sensors 27, 27 and 37, 37 may be omitted Moreover, in the above described embodiments, although the magnetic sensor 12 is provided upstream of the first pattern data detection unit 4 and the second pattern data detection unit 5, the magnetic sensor 12 may be provided downstream of the first pattern data detection unit 4 and the second pattern data detection unit 5 or may be provided between the first pattern data detection unit 4 and the second pattern data detection unit 5.

Furthermore, the reflection-type magnetic sensor 12 is used as the magnetic sensor 12 in the embodiments shown in FIGS. 1 to 15 so that the transmitting coil 12*a* and the receiving coil 12*b* constituting the magnetic sensor 12 are disposed on the same side of the coin passage and the transmission type magnetic sensor 12 is used as the magnetic sensor 12 in the embodiment shown in FIGS. 16 to 18 so that the transmitting coil 12*a* and the receiving coil 12*b* constituting the magnetic sensor 12 are disposed on the opposite sides of the coin passage 2. However, a transmission type magnetic sensor 12 may be used in the embodiments shown in FIGS. 1 to 15 and a reflection type magnetic sensor 12 may be used in the embodiment shown in FIGS. 16 to 18.

Further, in the above described embodiments, when the timing sensors 27, 27 or the timing sensors 37, 37 detect a coin 1, they output a light emission signal to the first light emitting means 21, the second light emitting means 31 or the light emitting means 21 so as to cause it to illuminate the coin 1 with light and the CCD area sensor 24 or the CCD area sensor 34 detects light reflected by the coin 1. However, it is possible to constitute the first light emitting means 21, the second light emitting means 31 or the light emitting means 21 so as to constantly emit light and the CCD area sensor 24 or the CCD area sensor 34 so as to detect light reflected by the coin 1 when the timing sensors 27, 27 or the timing sensors 37, 37 detect a coin 1.

Moreover, in the embodiment shown in FIGS. 16 to 18, the second optical discriminating means 68 discriminates whether or not a coin 1 is acceptable and the denomination of the coin 1 based on the pattern data of the coin 1 similarly to the second optical discriminating means 68 in the embodiment shown in FIGS. 6 to 15. However, the second optical discriminating means 68 in the embodiment shown in FIGS. 16 to 18 may be constituted so as to discriminate whether or not a coin 1 is acceptable and the denomination of the coin 1 based on the pattern data of the coin 1 similarly to the second optical discriminating means 68 in the embodiment shown in FIGS. 1 to 5.

Further, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin discriminating apparatus capable of accurately discriminating a counterfeit coin even when optical data acquired from the counterfeit coin such as diameter data and surface pattern data thereof coincide with those of genuine coins of a certain denomination and when the magnetic data acquired from the counterfeit coin are similar to those of coins of the denomination.

What is claimed is:

1. A coin discriminating apparatus comprising magnetic sensor means for detecting magnetic properties of a coin being transported and producing magnetic data of the coin, optical sensor means for producing optical data of the coin, reference optical data storing means for storing reference optical data of an obverse surface and a reverse surface of coins of each denomination, reference magnetic data storing means for storing reference magnetic data of an obverse surface and a reverse surface of coins of each denomination to be discriminated, first coin discriminating means for comparing optical data of the coin produced by the optical sensor means with reference optical data of an obverse surface and a reverse surface of coins of each denomination and determining whether or not the coin is acceptable and the denomination of the coin, and second coin discriminating means for reading from the reference magnetic data storing means magnetic reference data selected depending upon whether reference optical data of the obverse surface of a coin of a certain denomination or those of the reverse surface of the coin of the denomination were used when the first coin discriminating means determined the coin to be acceptable and the denomination of the coin based thereon and comparing them with the magnetic data produced by the magnetic sensor means, thereby finally discriminating whether or not the coin is acceptable and the denomination of the coin.

2. A coin discriminating apparatus in accordance with claim 1 wherein the magnetic sensor means comprises at least one transmitting coil and receiving coil pair and the members of the at least one transmitting coil and receiving coil pair are disposed on the same side of a coin being transported.

3. A coin discriminating apparatus in accordance with claim 1 wherein the magnetic sensor means comprises at least one transmitting coil and receiving coil pair and the members of the at least one transmitting coil and receiving coil pair are disposed on the different sides of a coin being transported.

4. A coin discriminating apparatus in accordance with claim 1 wherein the optical sensor means comprises a light source for emitting light toward one surface of the coin and light receiving means for photoelectrically receiving light emitted from the light source and reflected by the one surface of the coin and producing image pattern data of the one surface of the coin.

5. A coin discriminating apparatus in accordance with claim 2 wherein the optical sensor means comprises a light source for emitting light toward one surface of the coin and light receiving means for photoelectrically receiving light emitted from the light source and reflected by the one surface of the coin and producing image pattern data of the one surface of the coin.

6. A coin discriminating apparatus in accordance with claim 3 wherein the optical sensor means comprises a light source for emitting light toward one surface of the coin and light receiving means for photoelectrically receiving light emitted from the light source and reflected by the one surface of the coin and producing image pattern data of the one surface of the coin.

7. A coin discriminating apparatus in accordance with claim 4 wherein the image pattern data include data relating to diameter of the coin and pattern data and the reference optical data include reference data relating to diameters of coins of each denomination to be discriminated and reference pattern data of obverse surfaces and reverse surfaces of coins of each denomination and which further includes pattern data storing means for storing image pattern data.

8. A coin discriminating apparatus in accordance with claim 5 wherein the image pattern data include data relating to diameter of the coin and pattern data and the reference optical data include reference data relating to diameters of coins of each denomination to be discriminated and reference pattern data of obverse surfaces and reverse surfaces of coins of each denomination and which further includes pattern data storing means for storing image pattern data.

9. A coin discriminating apparatus in accordance with claim 6 wherein the image pattern data include data relating to diameter of the coin and pattern data and the reference optical data include reference data relating to diameters of coins of each denomination to be discriminated and reference pattern data of obverse surfaces and reverse surfaces of coins of each denomination and which further includes pattern data storing means for storing image pattern data.

10. A coin discriminating apparatus in accordance with claim 7 wherein the first coin discriminating means is adapted for comparing the data relating to diameter of the coin stored in the pattern data storing means and the reference data relating to diameter of coins of each denomination stored in the reference optical data storing means, thereby determining the denomination of the coin, reading the reference pattern data of obverse surfaces and reverse surfaces of coins of each denomination from the reference optical data storing means and comparing them with image pattern data of the coin stored in the pattern data storing means, thereby discriminating whether or not the coin is acceptable and the denomination of the coin, and the second coin discriminating means is adapted for reading from the reference magnetic data storing means magnetic reference data selected depending upon whether reference pattern data of the obverse surface of a coin of a certain denomination or those of the reverse surface of the coin of the denomination were used when the first coin discriminating means determined the coin to be acceptable and the denomination of the coin based thereon and comparing them with the magnetic data produced by the magnetic sensor means, thereby finally discriminating whether or not the coin is acceptable and the denomination of the coin.

11. A coin discriminating apparatus in accordance with claim 8 wherein the first coin discriminating means is adapted for comparing the data relating to diameter of the coin stored in the pattern data storing means and the reference data relating to diameter of coins of each denomination stored in the reference optical data storing means, thereby determining the denomination of the coin, reading the reference pattern data of obverse surfaces and reverse surfaces of coins of each denomination from the reference optical data storing means and comparing them with image pattern data of the coin stored in the pattern data storing means, thereby discriminating whether or not the coin is acceptable and the denomination of the coin, and the second coin discriminating means is adapted for reading from the reference magnetic data storing means magnetic reference data selected depending upon whether reference pattern data of the obverse surface of a coin of a certain denomination or those of the reverse surface of the coin of the denomination were used when the first coin discriminating means determined the coin to be acceptable and the denomination of the coin based thereon and comparing them with the magnetic data produced by the magnetic sensor means, thereby finally discriminating whether or not the coin is acceptable and the denomination of the coin.

12. A coin discriminating apparatus in accordance with claim 9 wherein the first coin discriminating means is adapted for comparing the data relating to diameter of the coin stored in the pattern data storing means and the reference data relating to diameter of coins of each denomination stored in the reference optical data storing means, thereby determining the denomination of the coin, reading the reference pattern data of obverse surfaces and reverse surfaces of coins of each denomination from the reference optical data storing means and comparing them with image pattern data of the coin stored in the pattern data storing means, thereby discriminating whether or not the coin is acceptable and the denomination of the coin, and the second coin discriminating means is adapted for reading from the reference magnetic data storing means magnetic reference data selected depending upon whether reference pattern data of the obverse surface of a coin of a certain denomination or those of the reverse surface of the coin of the denomination were used when the first coin discriminating means determined the coin to be acceptable and the denomination of the coin based thereon and comparing them with the magnetic data produced by the magnetic sensor means, thereby finally discriminating whether or not the coin is acceptable and the denomination of the coin.

13. A coin discriminating apparatus in accordance with claim 2 wherein the optical sensor means comprises a first light source for emitting light toward one surface of the coin, first light receiving means for photoelectrically receiving light emitted from the first light source and reflected by the one surface of the coin and producing image pattern data of the one surface of the coin, first pattern data storing means for storing the image pattern data of the one surface of the coin produced by the first light receiving means, a second light source for emitting light toward the other surface of the coin, second light receiving means for photoelectrically receiving light emitted from the second light source and reflected by the other surface of the coin and producing image pattern data of the other surface of the coin, and second pattern data storing means for storing the image pattern data of the other surface of the coin produced by the second light receiving means, the reference optical data storing means being adapted for storing reference pattern data of obverse surfaces and reverse surfaces of coins of each denomination, the first coin discriminating means includes first discriminating means for comparing the image pattern data of the one surface of the coin stored in the first pattern data storing means with the reference pattern data of obverse surfaces and reverse surfaces of coins of each denomination stored in the reference optical data storing means and determining whether or not the coin is acceptable and the denomination of the coin, second discriminating means for comparing the image pattern data of the other surface of the coin stored in the second pattern data storing means with the reference pattern data of obverse surfaces and reverse surfaces of coins of each denomination stored in the reference optical data storing means and determining whether or not the coin is acceptable and the denomination of the coin, and third discriminating means for determining whether or not the coin is acceptable and the denomination of the coin based on the results of discrimination made by the first discriminating means and the second discriminating means, the second coin discriminating means is adapted for reading from the reference magnetic data storing means reference magnetic data which correspond to the denomination of coin discriminated by the third discriminating means and which correspond to the coin surface used by whichever of the first discriminating means and the second discriminating means discriminated the denomination of the coin based on the image pattern data of a surface on the side of the transmitting coil of the magnetic sensor, and comparing them with the magnetic data of the coin produced by the magnetic sensor, thereby finally discriminating whether or not the coin is acceptable and the denomination of the coin.

14. A coin discriminating apparatus in accordance with claim 3 wherein the optical sensor means comprises a first light source for emitting light toward one surface of the coin, first light receiving means for photoelectrically receiving light emitted from the first light source and reflected by the one surface of the coin and producing image pattern data of the one surface of the coin, first pattern data storing means for storing the image pattern data of the one surface of the coin produced by the first light receiving means, a second light source for emitting light toward the other surface of the coin, second light receiving means for photoelectrically receiving light emitted from the second light source and reflected by the other surface of the coin and producing image pattern data of the other surface of the coin, and second pattern data storing means for storing the image pattern data of the other surface of the coin produced by the second light receiving means, the reference optical data storing means being adapted for storing reference pattern data of obverse surfaces and reverse surfaces of coins of each denomination, the first coin discriminating means includes first discriminating means for comparing the image pattern data of the one surface of the coin stored in the first pattern data storing means with the reference pattern data of obverse surfaces and reverse surfaces of coins of each denomination stored in the reference optical data storing means and determining whether or not the coin is acceptable and the denomination of the coin, second discriminating means for comparing the image pattern data of the other surface of the coin stored in the second pattern data storing means with the reference pattern data of obverse surfaces and reverse surfaces of coins of each denomination stored in the reference optical data storing means and determining whether or not the coin is acceptable and the denomination of the coin, and third discriminating means for determining whether or not the coin is acceptable and the denomination of the coin based on the results of discrimination made by the first discriminating means and the second discriminating means, the second coin discriminating means is adapted for reading from the reference magnetic data storing means reference magnetic data which correspond to the denomination of coin discriminated by the third discriminating means and which correspond to the coin surface used by whichever of the first discriminating means and the second discriminating means discriminated the denomination of the coin based on the image pattern data of a surface on the side of the transmitting coil of the magnetic sensor, and comparing them with the magnetic data of the coin produced by the magnetic sensor, thereby finally discriminating whether or not the coin is acceptable and the denomination of the coin.

15. A coin discriminating apparatus in accordance with claim 13 wherein the image pattern data include data relating to coin diameter and pattern data and the reference optical data include reference data relating to diameters of coins of all denominations and reference pattern data of obverse surfaces and reverse surfaces of coins of all denominations.

16. A coin discriminating apparatus in accordance with claim 14 wherein the image pattern data include data relating to coin diameter and pattern data and the reference optical data include reference data relating to diameters of coins of all denominations and reference pattern data of obverse surfaces and reverse surfaces of coins of all denominations.

17. A coin discriminating apparatus in accordance with claim 15 wherein the first discriminating means is adapted for comparing the data relating to coin diameter stored in the first pattern data storing means with reference data relating to diameters of coins of all denominations stored in the reference optical data storing means, thereby determining the denomination of the coin, reading the reference pattern data of an obverse surface and a reverse surface of a coin of the thus determined denomination from the reference optical data storing means and comparing them with image pattern data stored in the first pattern data storing means, thereby discriminating whether or not the coin is acceptable and the denomination of the coin, and the second coin discriminating means is adapted for comparing the data relating to coin diameter stored in the second pattern data storing means with reference data relating to diameters of coins of all denominations stored in the reference optical data storing means, thereby determining the denomination of the coin, reading the reference pattern data of an obverse surface and a reverse surface of a coin of the thus determined denomination from the reference optical data storing means and comparing them with the image pattern data stored in the second pattern data storing means, thereby discriminating whether or not the coin is acceptable and the denomination of the coin.

18. A coin discriminating apparatus in accordance with claim 16 wherein the first discriminating means is adapted for comparing the data relating to coin diameter stored in the first pattern data storing means with reference data relating to diameters of coins of all denominations stored in the reference optical data storing means, thereby determining the denomination of the coin, reading the reference pattern data of an obverse surface and a reverse surface of a coin of the thus determined denomination from the reference optical data storing means and comparing them with image pattern data stored in the first pattern data storing means, thereby discriminating whether or not the coin is acceptable and the denomination of the coin, and the second coin discriminating means is adapted for comparing the data relating to coin diameter stored in the second pattern data storing means with reference data relating to diameters of coins of all denominations stored in the reference optical data storing means, thereby determining the denomination of the coin, reading the reference pattern data of an obverse surface and a reverse surface of a coin of the thus determined denomination from the reference optical data storing means and comparing them with the image pattern data stored in the second pattern data storing means, thereby discriminating whether or not the coin is acceptable and the denomination of the coin.

19. A coin discriminating apparatus in accordance with claim 13 wherein the third discriminating means is adapted for discriminating that the coin is unacceptable when at least one of the first discriminating means and the second discriminating means determines that the coin is unacceptable, discriminating that the coin is unacceptable when the denomination of the coin determined by the first discriminating means and the denomination of the coin determined by the second discriminating means do not coincide with each other, and discriminating that the denomination of the coin coincides with the denomination determined by the first discriminating means and the second discriminating means when the denomination of the coin determined by the first discriminating means and the denomination of the coin determined by the second discriminating means coincide with each other, thereby outputting the denomination to the second coin discriminating means.

20. A coin discriminating apparatus in accordance with claim 14 wherein the third discriminating means is adapted for discriminating that the coin is unacceptable when at least one of the first discriminating means and the second discriminating means determines that the coin is unacceptable, discriminating that the coin is unacceptable when the denomination of the coin determined by the first discriminating means and the denomination of the coin determined by the second discriminating means do not coincide with each other, and discriminating that the denomination of the coin coincides with the denomination determined by the first discriminating means and the second discriminating means when the denomination of the coin determined by the first discriminating means and the denomination of the coin determined by the second discriminating means coincide with each other, thereby outputting the denomination to the second coin discriminating means.

21. A coin discriminating apparatus in accordance with claim 15 wherein the third discriminating means is adapted for discriminating that the coin is unacceptable when at least one of the first discriminating means and the second discriminating means determines that the coin is unacceptable, discriminating that the coin is unacceptable when the denomination of the coin determined by the first discriminating means and the denomination of the coin determined by the second discriminating means do not coincide with each other, and discriminating that the denomination of the coin coincides with the denomination determined by the first discriminating means and the second discriminating means when the denomination of the coin determined by the first discriminating means and the denomination of the coin determined by the second discriminating means coincide with each other, thereby outputting the denomination to the second coin discriminating means.

22. A coin discriminating apparatus in accordance with claim 16 wherein the third discriminating means is adapted for discriminating that the coin is unacceptable when at least one of the first discriminating means and the second discriminating means determines that the coin is unacceptable, discriminating that the coin is unacceptable when the denomination of the coin determined by the first discriminating means and the denomination of the coin determined by the second discriminating means do not coincide with each other, and discriminating that the denomination of the coin coincides with the denomination determined by the first discriminating means and the second discriminating means when the denomination of the coin determined by the first discriminating means and the denomination of the coin determined by the second discriminating means coincide with each other, thereby outputting the denomination to the second coin discriminating means.

23. A coin discriminating apparatus in accordance with claim 17 wherein the third discriminating means is adapted for discriminating that the coin is unacceptable when at least one of the first discriminating means and the second discriminating means determines that the coin is unacceptable, discriminating that the coin is unacceptable when the denomination of the coin determined by the first discriminating means and the denomination of the coin determined by the second discriminating means do not coincide with each other, and discriminating that the denomination of the coin coincides with the denomination determined by the first discriminating means and the second discriminating means when the denomination of the coin determined by the first discriminating means and the denomination of the coin determined by the second discriminating means coincide with each other, thereby outputting the denomination to the second coin discriminating means.

24. A coin discriminating apparatus in accordance with claim 18 wherein the third discriminating means is adapted for discriminating that the coin is unacceptable when at least one of the first discriminating means and the second discriminating means determines that the coin is unacceptable, discriminating that the coin is unacceptable when the denomination of the coin determined by the first discriminating means and the denomination of the coin determined by the second discriminating means do not coincide with each other, and discriminating that the denomination of the coin coincides with the denomination determined by the first discriminating means and the second discriminating means when the denomination of the coin determined by the first discriminating means and the denomination of the coin determined by the second discriminating means coincide with each other, thereby outputting the denomination to the second coin discriminating means.

* * * * *